US009470217B2

(12) United States Patent
Taravat et al.

(10) Patent No.: US 9,470,217 B2
(45) Date of Patent: Oct. 18, 2016

(54) METHOD AND DEVICE FOR MEASURING AND CONTROLLING AMOUNT OF LIQUID PUMPED

(71) Applicants: Mohsen Taravat, Ontario (CA); Hossein Nazarbolandjahromi, Ontario (CA)

(72) Inventors: Mohsen Taravat, Ontario (CA); Hossein Nazarbolandjahromi, Ontario (CA)

( * ) Notice: Subject to any disclaimer, the term of this patent is extended or adjusted under 35 U.S.C. 154(b) by 0 days.

(21) Appl. No.: 14/194,682

(22) Filed: Mar. 27, 2014

(65) Prior Publication Data

US 2014/0199183 A1 Jul. 17, 2014

(51) Int. Cl.

| | |
|---|---|
| ***F04B 17/03*** | (2006.01) |
| ***F04B 49/22*** | (2006.01) |
| ***F04B 49/06*** | (2006.01) |
| ***F04B 51/00*** | (2006.01) |

(52) U.S. Cl.

CPC ..... *F04B 17/03* (2013.01); *F04B 49/06* (2013.01); *F04B 49/065* (2013.01); *F04B 49/22* (2013.01); *F04B 51/00* (2013.01); *F04B 2203/0208* (2013.01); *F04B 2203/0209* (2013.01)

(58) Field of Classification Search

CPC .... F04B 17/03; F04B 49/065; F04B 49/103; F04B 49/106; F04B 2203/0208; F04B 2203/0209

USPC ..... 417/44.11, 300, 20, 22, 63; 702/100; 700/282; 73/1.16, 861

See application file for complete search history.

(56) References Cited

U.S. PATENT DOCUMENTS

| | | | | |
|---|---|---|---|---|
| 4,108,574 | A * | 8/1978 | Bartley et al. | 417/19 |
| 4,145,161 | A * | 3/1979 | Skinner | 417/22 |
| 6,464,464 | B2 * | 10/2002 | Sabini et al. | 417/19 |
| 6,591,697 | B2 * | 7/2003 | Henyan | 73/861.71 |
| 6,758,655 | B2 * | 7/2004 | Sacher | 417/19 |
| 7,734,441 | B2 * | 6/2010 | Taravat et al. | 702/100 |
| 7,845,913 | B2 * | 12/2010 | Stiles et al. | 417/44.11 |
| 7,945,411 | B2 * | 5/2011 | Kernan et al. | 702/100 |
| 8,303,260 | B2 * | 11/2012 | Stavale et al. | 417/43 |
| 8,500,413 | B2 * | 8/2013 | Stiles et al. | 417/44.1 |
| 8,700,221 | B2 * | 4/2014 | Cheng et al. | 700/282 |
| 2007/0212210 | A1 * | 9/2007 | Kernan et al. | 415/1 |
| 2012/0173027 | A1 * | 7/2012 | Cheng et al. | 700/282 |
| 2014/0135999 | A1 * | 5/2014 | Stavale | 700/282 |

* cited by examiner

*Primary Examiner* — Alexander Comley
(74) *Attorney, Agent, or Firm* — Barry Choobin; Patent 360

(57) ABSTRACT

The embodiments herein disclose a method and system for measuring and controlling an amount of flow and volume of liquid/fluid and/or electrical energy. The method and system obtains a plurality of values for the electrical parameters of an electro-pump, including voltage value, current value and active/reactive energy value; calculates the plurality values; and determines and controls the amount of instant flow and volume of the liquid/fluid based on the calculated values. The system/method gathers these two measuring and controlling features such as measuring and controlling the volume of liquid and amount of energy in one casing, thereby providing a secure reference for both the parameters at the same time for underground water resources.

6 Claims, 11 Drawing Sheets

METHOD AND DEVICE FOR MEASURING AND CONTROLLING AMOUNT OF LIQUID PUMPED

BACKGROUND

1. Technical Field

The embodiments herein generally relate to a system for monitoring and metering a liquid flow. The embodiments herein particularly relate to a system and method for measuring and controlling an amount of flow/volume of liquid pumped or transferred. The embodiments herein more particularly relate to a system and method for measuring and controlling underground water resources.

2. Description of the Related Art

Metering and controlling of water, that is pumped or transferred by pump from water resources, has always been challenging. Water turbulence, combining air with water, and tampering and cheating probability, etc., have made conventional measurement methods ineffective.

Rapid population growth and developing human activities increase the need for natural resources, especially available water. Therefore, access to water should be balanced and controlled by water resource management systems.

The scarcity of water wells in addition to the restrictive and harsh operating conditions that are imposed on their measuring equipment, cause a real paradox. On one hand, a complicated, industrial, and robust, measuring and controlling device, as well as an anti-tampering measuring/controlling device which is resistant to hard working conditions, is needed. On the other hand, the solution needs to be simple, maintenance-free, and inexpensive. The embodiments herein have solved the above paradox.

Hence there is a need for a robust, measuring and controlling device which is resistant to hard working conditions. Further there is need for a metering device which is also tamper proof. Still further there is a need for a simple maintenance-free, and inexpensive measuring/controlling device.

The abovementioned shortcomings, disadvantages and problems are addressed herein and which will be understood by reading and studying the following specification.

SUMMARY

The primary object of the embodiments herein is to provide a novel and more advantageous approach for the elimination of the aforementioned disadvantages.

In order to achieve this object, the embodiments herein disclose a method and system for measuring and controlling the amount of liquid and/or electrical energy consumption by an electro-pump, wherein said amount of liquid consumption comprises a flow and/or volume of said liquid that is pumped or transferred by said electro-pump. The method and system acquires or obtains a plurality of values for electrical parameters of the electro-pump, including a voltage value, a current value, and an active/reactive energy value; calculates a plurality of values; and determines and controls an amount of instant flow and volume of said liquid fluid based on said calculated plurality of values.

The system/method is provided to measure and control two features such as the volume of liquid and amount of energy in one casing thereby providing a secure reference for both the two parameters at the same time, for underground water resources.

The embodiments herein disclose a method and system for measuring the amounts of pumped liquid, wherein said amount of liquid consumption comprises a flow and/or volume of said liquid that is pumped or transferred by said pump. The method involves acquiring a plurality of values of instant power consumed by a pump and an instant rotational speed of the pump, uses the corrected and calibrated power-output flow curves of said pump, calculates the plurality values, and determines and controls the amount of instant flow and volume of said liquid fluid based on said calculated values. The first system based on this method obtains a plurality of values of instant power consumption of the pump and instant rotational speed of the pump directly. The system uses the corrected and calibrated power-output flow curves of said pump, calculates the plurality of values and determines and controls the amount of instant flow and volume of said liquid fluid based on said calculated plurality of values. The second system based on this method obtains a plurality of current and voltage levels of an electro-pump, obtains a plurality of active and reactive energies, an instant electrical power, and an instant power factor of said voltages; obtains a frequency of voltage feeds to the electro-pump; uses the corrected and calibrated power-output flow curves of said pump; calculates the plurality values; and determines and controls the amount of instant flow and volume of said liquid fluid based on said calculated values. This system could be used where the pump is driven by an electro-motor and electrical power resource of the pump is accessible and a rotational speed of the pump is proportional to a frequency of voltage of the power resource feeding to the electro-motor.

According to a preferred embodiment herein, a method comprises continuously measuring the currents and voltages of said electro-pump. The active and reactive energies, an instant electrical power, an instant power factor and a frequency of said voltages are continuously calculated and updated. Then an amount of said liquid consumption is continuously calculated and updated. The method of calculating and updating comprises the steps of collecting a power-output flow curve of said electro-pump as a first input data and an operating condition of the electro-pump as a second input data. The second input data comprises an instant flow and an instant electrical power consumed. The power-output flow curve is calibrated according to said operating condition. The amount of flow corresponding to the collected instant power is obtained from the calibrated power-output flow curve of said electro-pump. The volume of pumped or transferred liquid is continuously calculated by taking a time integral of the amount of flow. The amount of said measured current and voltage levels of said electro-pump, are continuously monitored, updated, displayed and/or recorded. The amount of said calculated active and reactive energies, an instant electrical power, an instant power factor and the frequency of said voltages are continuously monitored, updated, displayed and/or recording. The amount of said energy consumed by said electro-pump is continuously monitored, updated, displayed and/or recorded as an updated amount of electrical energy consumption. The amount of said liquid consumption is continuously monitored, updated, displayed and/or recorded as an updated amount of liquid consumption.

According to an embodiment herein, the method further comprises controlling the amount of said liquid and/or electrical energy consumption. The method further comprises designating a predetermined amount of liquid and/or electrical energy consumption, which is allowable, to a smart-card which is identified with an electro-pump. A communication between said smart-card and a smart-card reader is established for a bilateral data transmission for checking, determining and confirming a validity of said smart-card. The maximum predetermined amount of liquid consumption allowable is read from said smart-card and is characterized as a liquid credit. The maximum predetermined amount of electrical energy consumption allowable is read from said smart-card is characterized as an energy credit. The liquid credit is continuously updated by subtracting the updated liquid consumption from said liquid credit and an updated amount of allowable liquid consumption is obtained. The energy credit is continuously updated by subtracting the updated energy consumption from said energy credit and an updated amount of allowable electrical energy consumption is obtained.

According to an embodiment herein, the method further comprises recording said amount of updated liquid and/or electrical energy consumption. When said amount of updated liquid and/or electrical energy consumption exceeds said maximum allowable liquid and/or electrical energy consumption, an amount of liquid and/or electrical energy consumption exceeding the maximum allowable amount of liquid and/or electrical energy consumption is obtained and recorded.

According to an embodiment herein, the method further comprises sending an optional interruption signal to disable said electro-pump, when said amount of updated liquid and/or electrical energy consumption exceeds said maximum allowable amount of liquid and/or electrical energy consumption.

According to an embodiment herein, the method further comprises storing said calculated and updated active and reactive energies, said amount of updated of said liquid consumption, said updated liquid credit, said updated electrical energy credit and said amount exceeding the maximum allowable limit of liquid and/or electrical energy consumption.

According to an embodiment herein, a system for measuring and controlling an amount of liquid and/or electrical energy consumption consumed by an electro-pump is provided. The amount of liquid consumption comprises a flow and/or volume of said liquid that is pumped or transferred by said electro-pump. The system comprises a means for continuously measuring the current and voltage levels of said electro-pump, a means for continuously calculating and updating said active and reactive energies, an instant electrical power, an instant power factor and frequency of said voltages, and a means for continuously calculating and updating the amount of said liquid consumption. The means for calculating and updating comprises a means for taking a power-output flow curve of said electro-pump as a first input data and a means for taking an operating condition of the electro-pump as second input data. Wherein said second input data comprises an instant flow and instant consumed electrical power. A means for calibrating the power-output flow curve according to said operating condition is used to obtain a calibrated power-output flow curve. A means for obtaining the amount of flow from the calibrated power-output flow curve of said electro-pump corresponding to the measured instant power is provided. A means for continuously calculating the volume of pumped or transferred liquid is provided to compute a time integral of the amount of flow. A means for continuously monitoring, updating, displaying and/or recording the amount of said measured currents and voltages of said electro-pump is provided in the system. A means is provided for continuously monitoring, updating, displaying, and/or recording the amount of said calculated active and reactive energies, the instant electrical power, the instant power factor and the frequency of said voltages. A means for continuously monitoring, updating, displaying, and/or recording the amount of said energy consumed by said electro-pump as an updated amount of electrical energy consumption is installed in the system. A means for continuously monitoring, updating, displaying, and/or recording the amount of said liquid consumption as an updated amount of liquid consumption is used.

According to an embodiment herein, the system comprises a means for controlling the amount of said liquid and/or electrical energy consumption and wherein said system further comprises a means for designating a predetermined amount of allowable liquid and/or electrical energy consumption to a smartcard, which is identified with an electro-pump. The system further comprises a means for communicating with said smartcard for a bilateral data transmission via a smartcard reader, a means for checking, determining and confirming the validity of said smartcard, a means for reading the maximum predetermined amount of allowable liquid consumption from said smartcard, which is characterized as liquid credit, a means for reading the maximum predetermined amount of allowable electrical energy consumption from said smartcard, which is characterized as an energy credit, a means for continuously updating the liquid credit by subtracting the updated liquid consumption from said liquid credit and obtaining an updated amount of allowable liquid consumption, a means for continuously updating the energy credit by subtracting the updated energy consumption from said energy credit and obtaining an updated amount of allowable electrical energy consumption.

According to an embodiment herein, the method further comprises controlling the liquid credits and wherein said liquid credits comprise the amount of said liquid consumption, maximum flow of said liquid, allowable working hours, and allowable date and time. Said method further comprises designating a predetermined liquid credits and activating a bilateral data transferring means for transferring the designated predetermined liquid credits via a communication port. A validity of an exchanged data is checked, determined and confirmed. The liquid credit is continuously updating by subtracting the updated liquid consumption from said liquid credit and an updated amount of liquid consumption allowed is obtained. An interruption signal is sent to connect or disconnect said pump or electro-pump.

According to an embodiment herein, a system comprises a means for recording said amount of updated liquid and/or electrical energy consumption. When said amount of updated liquid and/or electrical energy consumption exceeds said maximum allowable limit of liquid and/or electrical energy consumption, a means is provided for obtaining and recording the amount exceeding the maximum allowable limit of liquid and/or electrical energy consumption.

According to an embodiment herein, a system comprises a means for sending an optional interruption signal to disable said electro-pump, when said amount of updated liquid and/or electrical energy consumption exceeds said maximum allowable limit of liquid and/or electrical energy consumption.

According to an embodiment herein, a system comprises a means for storing said calculated and updated active and reactive energies, said updated amount of said liquid consumption, said updated liquid credit, said updated electrical energy credit, and said calculated amount exceeding the maximum allowable limit of liquid and/or electrical energy consumption on said smartcard.

According to an embodiment herein, a method comprises continuously measuring the instant power consumption and instant rotational speed of said pump. The flow of said liquid pumped or transferred by pump is continuously calculated and updated. The amount of said liquid pumped or transferred by pump is continuously calculated, monitored, updated, displayed and/or recorded. The process of calculating and updating comprises the steps of calibrating the power-output flow curve of said pump at constant rotational speed, measuring an instant rotational speed of the pump, correcting the calibrated power-output flow curve of said pump, obtaining the amount of flow corresponding to the measured instant power consumption and the measured instant rotational speed from the corrected-calibrated power-output flow curve of said pump, and continuously calculating the volume of liquid pumped or transferred by performing a time integral of the amount of flow. The process of said calibrating the power-output flow curve of said pump at constant rotational speed comprises the steps of collecting a predetermined power-output flow curve of said pump as a first input data, and collecting one or more operating conditions of the pump as second input data. Said second input data comprises an instant flow of the pump and an instant power consumption of the pump at a constant rotational speed. The predetermined power-output flow curve is calibrated according to the collected operating conditions of the pump or the second input data comprising the instant flow of the pump and the instant power consumption of the pump at a constant rotational speed. The working condition of the pump is changed by changing a total discharge pressure of the pump and the instant power consumption and the instant flow of the pump at the changed working conditions. A power-output flow curve of said pump is created by changing the working conditions for one or more times.

According to an embodiment herein, a system is provided for measuring and controlling an amount of liquid consumed. The amount of liquid consumed includes a flow and/or volume of said liquid that is pumped or transferred by said pump. The system comprises a means for continuously measuring the instant power consumption of the pump and a means for continuously measuring an instant rotational speed of the pump directly. A means is provided for continuously calculating and updating the amount of said liquid consumed. The amount of said liquid consumed is calculated and updated by using a means for calibrating the power-output flow curve of said pump at a constant rotational speed. The instant rotational speed of the pump is measured to correcting a calibrated power-output flow curve of said pump. The amount of flow corresponding to the measured instant power consumption of the pump is collected from the corrected-calibrated power-output flow curve of said pump. A means is provided for continuously calculating the volume of pumped or transferred liquid by performing a time integral of the amount of flow. A means is provided for registering and displaying the amounts of flow and/or volume of liquid that is pumped or transferred by said pump in periodic time intervals. A means is provided for calculating, registering and displaying the maximum flow and/or volume of liquid that is pumped or transferred by said pump in the periodic time intervals. A means is provided for calculating, registering and displaying the working hours of the pump.

According to an embodiment herein, a system is provided for measuring and controlling the amount of liquid consumption. The amount of liquid consumption comprises the flow and/or volume of said liquid that is pumped or transferred by electro-pump. The system comprises a means for continuously measuring currents and voltages of said electro-pump; a means for continuously calculating and updating active and reactive energies, instant electrical power, instant power factor of said voltages; and a means for continuously calculating and updating the amount of said liquid consumption. The amount of liquid consumed is calculated and updated using a means for calibrating the power-output flow curve of said pump at a constant rotational speed; a means for measuring the frequency of voltage feeds electro-pump and correcting calibrated power-output flow curve of said pump; a means for obtaining the amount of flow from the corrected-calibrated power-output flow curve of said pump corresponding to the measured instant power; a means for continuously calculating the volume of liquid pumped or transferred by taking a time integral of the amount of flow; a means for registering and displaying the amount of flow and/or volume of liquid that is pumped or transferred by said pump in time intervals; a means for calculating, registering and displaying the maximum flow and/or volume of liquid that is pumped or transferred by said pump in time intervals; a means for calculating, registering and displaying the working hours of a pump; a means for registering and displaying the measured electrical parameters, including voltages, currents, active power and energy, reactive power and energy, and frequency in different registers and tariffs; and a means for changing tariffs by time, date and/or amount of liquid that is pumped or transferred.

According to an embodiment herein, the system comprises a means for communications for transferring data, settings and commands via different types of communication media and protocols such as GSM/GPRS, SMS, ZigBee, RF, M-Bus, RS485, RS232, PLC, DLC, smartcard, etc.

According to an embodiment herein, a system or means is added to conventional energy/power meters to calculate/register/manage the volume and flow of pumped liquid. The system comprises a means for calculating/registering/managing volume and flow of pumped liquid as a part of a distributed system by gathering/collecting the needed information from the conventional measuring tools; a means for calculating/registering/managing volume and flow of pumped liquid that is integrated with pump drivers; a self-determining device that measures/calculates/registers/manages the volume and flow of pumped liquid based on the required information collected from the conventional measuring tools; and a self-determining, integrated device that measures/calculates/registers/manages consumed energy/power/rotational speed, if applicable, and the volume and flow of liquid pumped.

The various embodiments herein provide a method for measuring the amount of flow and/or volume of liquid that is pumped or transferred by pump. The method comprises continuously measuring the instant power consumed by the pump, continuously measuring the instant rotational speed of the pump, continuously calculating and updating the amount of said liquid pumped or transferred, and continuously monitoring, updating, displaying and/or recording the amount of said liquid consumption. The method of calculating and updating comprises the step of calibrating the power-output flow curve of said pump in constant rotational speed. The step of calibrating the power-output flow curve comprises taking a predetermined power-output flow curve of said pump as a first input data, taking one or more operating conditions of the pump as second input data. The second input data comprises the instant flow and instant power consumption of the pump at the constant rotational speed of the pump. The step of calibrating the power-output flow curve further comprises calibrating the predetermined power-output flow curve according to said operating conditions, obtaining a calibrated power-output flow curve, measuring an instant power consumption and an instant flow of said pump, changing the working conditions of the pump by changing the total discharge pressure of the pump, measuring the instant power consumption and instant flow of the pump at the changed working condition, and creating power-output flow curve of said pump by changing the working conditions for one or more times. The step of calculating and updating further comprises measuring the instant rotational speed of the pump at each changed working condition and correcting calibrated power-output flow curve of said pump, obtaining the amount of flow corresponding to the measured instant power consumption of the pump from the corrected-calibrated power-output flow curve of said pump and continuously calculating the volume of liquid pumped or transferred by taking a time integral of the amount of flow obtained from the calibration corrected power-output flow curve of the pump.

A system for measuring the amounts of liquid pumped is provided. The said amount of liquid pumped comprises the flow and/or volume of said liquid that is pumped or transferred by said pump. The system comprises a means for continuously measuring the instant power consumption of the pump, a means for continuously measuring the instant rotational speed of the pump, and a means for continuously calculating and updating the amount of said liquid consumption.

The said means for continuously calculating and updating the amount of said liquid consumption comprises a means for calibrating the power-output flow curve of said pump at constant rotational speed, a means for measuring the instant rotational speed of the pump and correcting the calibrated power-output flow curve of said pump, a means for obtaining the amount of flow corresponding to the measured the instant power consumption of the pump from the calibration corrected power-output flow curve of said pump, and a means for continuously calculating the volume of pumped or transferred liquid by taking a time integral of the amount of flow obtained from the calibration corrected power-output flow curve of said pump.

The said means for calibrating the power-output flow curve comprises a means for taking a predetermined power-output flow curve of said pump as a first input data and a means for taking one or more operating conditions of the pump as a second input data. The said second input data comprises the instant flow and instant power consumption of the pump at a constant rotational speed of the pump. The said means for calibrating the power-output flow curve further comprises a means for calibrating the predetermined power-output flow curve according to said operating conditions and obtaining a calibrated power-output flow curve, a means for measuring an instant power consumption and instant flow of said pump, a means for changing the working conditions of the pump by changing the total discharge pressure of the electro-pump and measuring the instant power consumption and an instant flow of the pump at the changed working condition, and a means for creating a power-output flow curve of said electro-pump by changing of the working conditions of the pump for multiple times.

A system for measuring the amount of liquid pumped by the electro-pump is provided. The said amount of liquid comprises the flow and/or volume of said liquid that is pumped or transferred by said pump. The said electro-pump means comprises a means for continuously measuring the currents and the voltages of said electro-pump, a means for continuously calculating and updating active and reactive energies, instant electrical power, and instant power factor of said voltages, and a means for continuously calculating and updating the amount of said liquid consumption. The said means for calculating and updating comprises a means for calibrating the power-output flow curve of said electro-pump at constant rotational speed, a means for measuring the frequency of voltage feeds electro-pump and correcting the calibrated power-output flow curve of said pump, a means for obtaining the amount of flow corresponding to the measured power consumption from the calibration corrected power-output flow curve of said pump, and a means for continuously calculating the volume of pumped or transferred liquid by taking a time integral of the amount of flow obtained from the calibration corrected power-output flow curve of said pump.

The said means for calibrating of the power-output flow curve of the electro-pump comprises a means for taking a predetermined power-output flow curve of said pump as a first input data and a means for taking one or more operating conditions of the electro-pump as second input data. The said second input data comprises the instant flow and instant power consumption of the electro-pump at a constant rotational speed. The said means for calibrating of the power-output flow curve further comprises a means for calibrating the predetermined power-output flow curve according to said operating conditions and obtaining a calibrated power-output flow curve, a means for measuring an instant power consumption and instant flow of said electro-pump, a means for changing the working conditions of the electro-pump by changing the total discharge pressure of the electro-pump, and measuring the instant power consumption and instant flow of the electro-pump, and a means for creating a power-output flow curve of said electro-pump by changing the working conditions of the electro-pump.

The said system for measuring the amount of liquid pumped by electro-pump further comprises a means for registering and displaying the amount of flow and/or volume of liquid that is pumped or transferred by said electro-pump in periodic time intervals, a means for calculating, registering and displaying the maximum amount flow and/or volume of liquid that is pumped or transferred by said electro-pump in periodic time intervals, and a means for calculating, registering and displaying the working hours of the electro-pump.

The said system for measuring the amount of liquid pumped by electro-pump further comprises a means for registering and displaying the measured electrical parameters, including voltages, currents, active power and energy, reactive power and energy, and frequency in different registers and tariffs and a means for changing tariffs by time, date and/or amounts of liquid pumped or transferred.

The said system for measuring the amount of liquid pumped by electro-pump further comprises a means for communicating for transferring data, settings and commands via different type of communication media and protocols such as GSM/GPRS, SMS, ZigBee, RF, M-Bus, RS485, RS232, PLC, DLC and smartcard, and a means for controlling the liquid credits. The said liquid credits comprise the amount of said liquid consumption/maximum flow of said liquid/allowable working hours/allowable date and time.

The said system for measuring the amount of liquid pumped by electro-pump further comprises a means for designating predetermined liquid credits, a means for bilateral transfer of predetermined liquid credits via said communication port, a means for checking, determining and confirming the validity of exchanged data, and a means for continuously updating the liquid credits by subtracting the updated liquid consumption from said liquid credit and obtaining an updated allowable limit of liquid consumption.

The said system for measuring the amount of liquid pumped by an electro-pump also comprises a means for sending an interruption signal to control a connection or disconnection of said pump or electro-pump.

According to an embodiment herein, the developed metering system provides a unique and applicable solution for monitoring and managing valuable water resources. The developed meter is simple to install, operate, and maintain. At the same time, the developed meter is robust, accurate and more economical. Furthermore, the amount of flow/volume of liquid that pumped or transferred by an electro-pump, unlike conventional water meters such as displacement water meters, velocity water meters, electromagnetic meters and ultrasonic meters, is determined based on electrical parameters such as instant power, instant rotational speed and corrected-calibrated power-flow curve of pumps, etc. The electro-pump, includes all pumps but not limited to, pumps that are powered by electro-motor or diesel. The meter which is developed based on the embodiments herein overcomes the disadvantages and problems of conventional water meters used for measuring and monitoring the water pumped out of underground water resources and especially the problem of preventing from illegal water/energy consumption using a built-in controlling/managing system.

The embodiments herein integrate the features of measuring and controlling the volume of liquid and the amount of energy in one casing, thereby, providing a secure reference for both the parameters at the same time for underground water resources.

The various embodiments herein provide a method for measuring the amount of flow and/or volume of liquid that is pumped or transferred by pump. The method comprises continuously measuring the instant power consumption of the pump, measuring instant rotational speed of the pump continuously, calculating and updating the amount of said liquid pumped or transferred continuously, and monitoring, updating, displaying and/or recording the amount of said liquid consumption continuously. The method of calculating and updating comprises the steps of calibrating the power-output flow curve of said pump in constant rotational speed. The step of calibrating the power-output flow curve comprises taking a predetermined power-output flow curve of said pump as a first input data and taking one or more operating conditions of the pump as the second input data. The second input data comprises the instant-flow and instant power consumption of the pump at a constant rotational speed of the pump. The step of calibrating the power-output flow curve further comprises calibrating the predetermined power-output flow curve according to said operating conditions and obtaining a calibrated power-output flow curve, measuring an instant power consumption and an instant flow rate of said pump, changing the working conditions of the pump by changing the total discharge pressure pump, measuring the instant power consumption and the instant flow rate of the pump at the changed working condition, and creating a power-output flow curve of said pump by changing the working conditions for multiple times.

The step of calculating and updating the amount of said liquid pumped or transferred by the pump further comprises measuring the instant rotational speed of the pump, correcting the calibration power-output flow curve of said pump, obtaining the amount of flow corresponding to the measured instant power consumption of the pump from the calibration corrected power-output flow curve of said, and continuously calculating the volume of pumped or transferred liquid by taking a time integral of the amount of flow obtained from the calibration corrected power-output flow curve.

A system for measuring the amount of liquid pumped is provided. The said amount of liquid comprises the flow rate and/or volume of said liquid that is pumped or transferred by said pump. The system comprises a means for continuously measuring the instant power consumption of the pump, a means for continuously measuring the instant rotational speed of the pump, and a means for continuously calculating and updating the amount of said liquid consumption.

The said means for calculating and updating the amount of said liquid consumption comprises a means for calibrating the power-output flow curve of said pump at a constant rotational speed, a means for measuring the instant rotational speed of the pump and correcting the calibrated power-output flow curve of said pump, a means for obtaining the amount of flow corresponding to the measured instant power consumption of the pump from the calibration corrected power-output flow curve of said pump, and a means for continuously calculating the volume of pumped or transferred liquid by taking a time integral of the amount of flow obtained from the calibration corrected power-output flow curve.

The said means for calibrating the power-output flow curve comprises a means for taking a predetermined power-output flow curve of said pump as a first input data and a means for taking one or more operating conditions of the pump as second input data. The said second input data comprises the instant flow and instant power consumption at a constant rotational speed of the pump. The said means for calibrating the power-output flow curve further comprises a means for calibrating the predetermined power-output flow curve according to said operating conditions and obtaining a calibrated power-output flow curve, a means for measuring the instant power consumption and instant flow of said pump, a means for changing the working conditions of the pump by changing the total discharge pressure of the electro-pump, measuring an instant power consumption and an instant flow of the pump, and a means for creating a power-output flow curve of said electro-pump by changing the working conditions of the pump for multiple times.

A system for measuring the amount of liquid pumped by an electro-pump is provided. The said amount of liquid comprises the flow and/or volume of said liquid that is pumped or transferred by said electro-pump. The said electro-pump is a pump that is provided with an electro-motor. The system comprises a means for continuously measuring the current and voltage of said electro-pump, a means for continuously calculating and updating active and reactive energies, instant electrical power, instant power factor of said voltages, and a means for continuously calculating and updating the amount of said liquid consumption.

The said means for calculating and updating the amount of said liquid consumption comprises a means for calibrating the power-output flow curve of said electro-pump at a constant rotational speed, a means for measuring the frequency of voltage feeds electro-pump and correcting the calibrated the power-output flow curve of said electro-pump, a means for obtaining the amount of flow corresponding to the measured power consumption from the calibration corrected power-output flow curve of said electro-pump, and a means for continuously calculating the volume of pumped or transferred liquid by taking a time integral of the amount of flow obtained from the calibration corrected power-output flow curve.

The said means for calibrating the power-output flow curve comprises a means for taking a predetermined power-output flow curve of said electro-pump as a first input data and a means for taking one or more operating conditions of the electro-pump as second input data. The said second input data comprises the instant flow and instant power consumption of the electro-pump at a constant rotational speed of the electro-pump. The said means for calibrating of the power-output flow curve further comprises a means for calibrating the predetermined power-output flow curve according to said operating conditions of the electro-pump and obtaining a calibrated power-output flow curve, a means for measuring instant power consumption and instant flow of said electro-pump, a means for changing the working conditions of the electro-pump by changing the total discharge pressure of the electro-pump, a means for measuring the instant power consumption and the instant flow of the electro-pump at the changed working condition, and a means for creating a power-output flow curve of said electro-pump by changing the working conditions of the electro-pump for multiple times.

The said system for measuring the amount of liquid pumped by electro-pump further comprises a means for registering and displaying the amounts of flow and/or volume of liquid that is pumped or transferred by said electro-pump in preset time intervals; a means for calculating, registering and displaying the maximum flow and/or volume of liquid that is pumped or transferred by said electro-pump in the preset time intervals, and a means for calculating, registering and displaying the working hours of the electro-pump.

The said system for measuring the amount of liquid pumped by electro-pump further comprises a means for registering and displaying the measured electrical parameters, including voltages, currents, active power and energy, reactive power and energy, frequency in different registers and tariffs, and a means for changing tariffs by time, date and/or amount of pumped or transferred liquid.

The said system for measuring the amount of liquid pumped by electro-pump further comprises a means for communicating for transferring data, settings and commands via different type of communication media and protocols such as GSM/GPRS, SMS, ZigBee, RF, M-Bus, RS485, RS232, PLC, DLC, and smartcard, and a means for controlling the liquid credits. The said liquid credits comprise the amount of said liquid consumption/maximum flow of said liquid/allowable working hours/allowable date and time.

The said system further comprises a means for designating predetermined liquid credits, a means for transferring predetermined liquid credits via said communication port bilaterally; a means for checking, determining and confirming the validity of exchanged data; and a means for continuously updating the liquid credits by subtracting the updated liquid consumption from said liquid credit and obtaining an updated allowable limit of liquid consumption.

The said system for measuring the amounts of liquid pumped by electro-pump also comprises a means for sending an interruption signal to control the connecting/disconnecting operations of said pump/electro-pump. The said system for measuring the amounts of liquid pumped by electro-pump is implemented as a self-determining integrated device that measures/calculates/registers/manages the consumed energy/power/rotational speed and the volume and flow of pumped liquid. The self-determining device measures/calculates/registers/manages the volume and flow of pumped liquid by collecting the required information from conventional measuring tools.

The said system for measuring the amount of liquid pumped by electro-pump comprises a means for adding to conventional energy/power meters to calculate/register/manage the volume and flow of pumped liquid, a means for calculating/registering/managing volume and flow of pumped liquid as a part of a distributed system by collecting the needed information from conventional measuring tools, and a means integrated with the pump drivers for calculating/registering/managing volume and flow of pumped liquid.

These and other aspects of the embodiments herein will be better appreciated and understood when considered in conjunction with the following description and accompanying drawings. It should be understood, however, that the following descriptions, while indicating preferred embodiments and numerous specific details thereof, are given by way of illustration and not of limitation. Many changes and modifications may be made within the scope of the embodiments herein without departing from the spirit thereof, and the embodiments herein include all such modifications.

BRIEF DESCRIPTION OF THE DRAWINGS

The other objects, features and advantages will occur to those skilled in the art from the following description of the preferred embodiment and the accompanying drawings in which.

Figure 1:
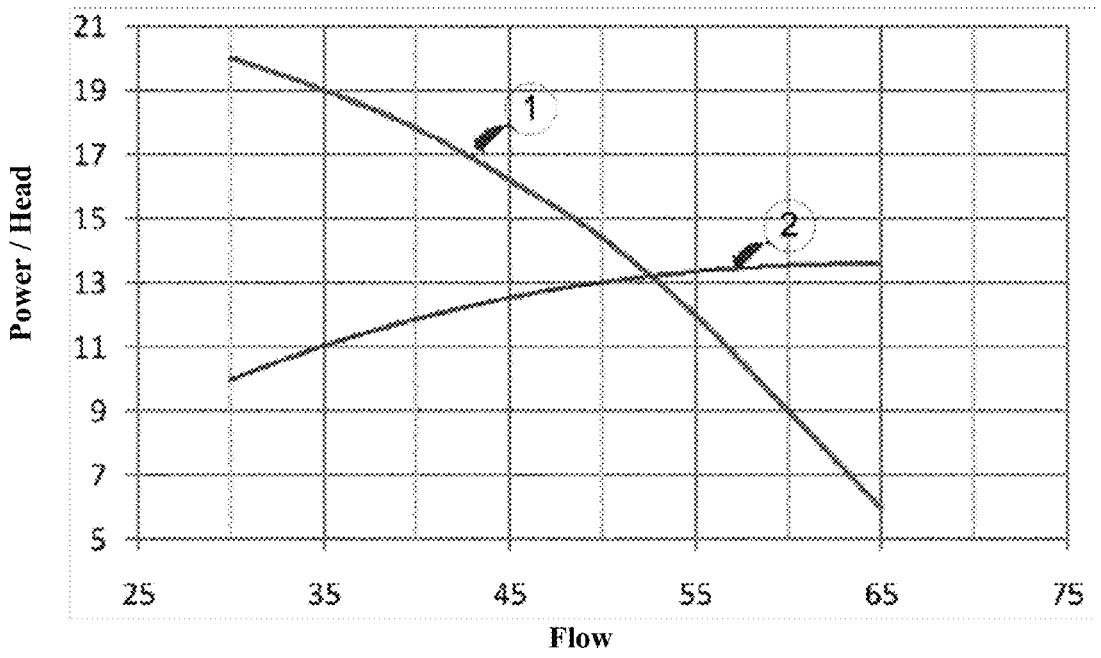
FIG. 1 illustrates the head-flow and power-flow curves of a typical pump, according to an embodiment herein.

Although the specific features of the embodiments herein are shown in some drawings and not in others. This is done for convenience only as each feature may be combined with any or all of the other features in accordance with the embodiments herein.

DETAILED DESCRIPTION OF THE DRAWINGS

In the following detailed description, a reference is made to the accompanying drawings that form a part hereof, and in which the specific embodiments that may be practiced is shown by way of illustration. These embodiments are described in sufficient detail to enable those skilled in the art to practice the embodiments and it is to be understood that the logical, mechanical and other changes may be made without departing from the scope of the embodiments. The following detailed description is therefore not to be taken in a limiting sense.

The embodiments herein disclose a method and system for measuring and controlling the amount of liquid and/or electrical energy consumption by an electro-pump, wherein said amount of liquid consumption comprises a flow and/or volume of said liquid that is pumped or transferred by said electro-pump. The method and system acquires or obtains a plurality of values for electrical parameters of the electro-pump, including a voltage value, a current value, and an active/reactive energy value; calculates a plurality of values; and determines and controls an amount of instant flow and volume of said liquid fluid based on said calculated plurality of values.

The system/method is provided for measuring and controlling two features such as the volume of liquid and amount of energy in one casing thereby providing a secure reference for both the two parameters at the same time, for underground water resources.

The embodiments herein disclose a method and system for measuring the amounts of pumped liquid, wherein said amount of liquid consumption comprises a flow and/or volume of said liquid that is pumped or transferred by said pump. The method involves acquiring a plurality of values of instant power consumed by a pump and an instant rotational speed of the pump, uses the corrected and calibrated power-output flow curves of said pump, calculates the plurality values, and determines and controls the amount of instant flow and volume of said liquid fluid based on said calculated values. The first system based on this method obtains a plurality of values of instant power consumed by the pump and instant rotational speed of the pump directly. The system uses the corrected and calibrated power-output flow curves of said pump, calculates the plurality of values and determines and controls the amount of instant flow and volume of said liquid fluid based on said calculated plurality of values. The second system based on this method obtains a plurality of current and voltage levels of an electro-pump, obtains a plurality of active and reactive energies, an instant electrical power, and an instant power factor of said voltages; obtains a frequency of voltage feeds to the electro-pump; uses the corrected and calibrated power-output flow curves of said pump; calculates the plurality values; and determines and controls the amount of instant flow and volume of said liquid fluid based on said calculated values. This system could be used where the pump is driven by an electro-motor and electrical power resource of the pump is accessible and a rotational speed of the pump is proportional to a frequency of voltage of the power resource feeding to the electro-motor.

According to a preferred embodiment herein, a method comprises continuously measuring the currents and voltages of said electro-pump. The active and reactive energies, an instant electrical power, an instant power factor and a frequency of said voltages are continuously calculated and updated. Then an amount of said liquid consumption is continuously calculated and updated. The method of calculating and updating comprises the steps of collecting a power-output flow curve of said electro-pump as a first input data and an operating condition of the electro-pump as a second input data. The second input data comprises an instant flow and an instant electrical power consumed. The power-output flow curve is calibrated according to said operating condition. The amount of flow corresponding to the collected instant power is obtained from the calibrated power-output flow curve of said electro-pump. The volume of pumped or transferred liquid is continuously calculated by taking a time integral of the amount of flow. The amount of said measured currents and voltages of said electro-pump, are continuously monitored, updated, displayed and/or recorded. The amount of said calculated active and reactive energies, an instant electrical power, an instant power factor and the frequency of said voltages are continuously monitored, updated, displayed and/or recording. The amount of said energy consumed by said electro-pump is continuously monitored, updated, displayed and/or recorded as an updated amount of electrical energy consumption. The amount of said liquid consumption is continuously monitored, updated, displayed and/or recorded as an updated amount of liquid consumption.

According to an embodiment herein, the method further comprises controlling the amount of said liquid and/or electrical energy consumption. The method further comprises designating a predetermined amount of liquid and/or electrical energy consumption, which is allowable, to a smart-card which is identified with an electro-pump. A communication between said smart-card and a smart-card reader is established for a bilateral data transmission for checking, determining and confirming, a validity of said smart-card. The maximum predetermined amount of liquid consumption allowable is read from said smart-card and is characterized as a liquid credit. The maximum predetermined amount of electrical energy consumption allowable is read from said smart-card is characterized as an energy credit. The liquid credit is continuously updated by subtracting the updated liquid consumption from said liquid credit and an updated amount of allowable liquid consumption is obtained. The energy credit is continuously updated by subtracting the updated energy consumption from said energy credit and an updated amount of allowable electrical energy consumption is obtained.

According to an embodiment herein, the method further comprises recording said amount of updated liquid and/or electrical energy consumption. When said amount of updated liquid and/or electrical energy consumption exceeds said maximum allowable liquid and/or electrical energy consumption, an amount of liquid and/or electrical energy consumption exceeding the maximum allowable amount of liquid and/or electrical energy consumption is obtained and recorded.

According to an embodiment herein, the method further comprises sending an optional interruption signal to disable said electro-pump, when said amount of updated liquid and/or electrical energy consumption exceeds said maximum allowable amount of liquid and/or electrical energy consumption.

According to an embodiment herein, the method further comprises storing said calculated and updated active and reactive energies, said amount of updated of said liquid consumption, said updated liquid credit, said updated electrical energy credit and said amount exceeding the maximum allowable limit of liquid and/or electrical energy consumption.

According to an embodiment herein, a system for measuring and controlling an amount of liquid and/or electrical energy consumption consumed by an electro-pump is provided. The amount of liquid consumption comprises a flow and/or volume of said liquid that is pumped or transferred by said electro-pump. The system comprises a means for continuously measuring the currents and voltages of said electro-pump, a means for continuously calculating and updating said active and reactive energies, an instant electrical power, an instant power factor and frequency of said voltages, and a means for continuously calculating and updating the amount of said liquid consumption. The means for calculating and updating comprises a means for taking a power-output flow curve of said electro-pump as a first input data and a means for taking an operating condition of the electro-pump as second input data. Wherein said second input data comprises an instant flow and instant consumed electrical power. A means for calibrating the power-output flow curve according to said operating condition is used to obtain a calibrated power-output flow curve. A means for obtaining the amount of flow from the calibrated power-output flow curve of said electro-pump corresponding to the measured instant power is provided. A means for continuously calculating the volume of pumped or transferred liquid is provided to compute a time integral of the amount of flow. A means for continuously monitoring, updating, displaying and/or recording the amount of said measured currents and voltages of said electro-pump is provided in the system. A means is provided for continuously monitoring, updating, displaying, and/or recording the amount of said calculated active and reactive energies, the instant electrical power, the instant power factor and the frequency of said voltages. A means for continuously monitoring, updating, displaying, and/or recording the amount of said energy consumed by said electro-pump as an updated amount of electrical energy consumption is installed in the system. A means for continuously monitoring, updating, displaying, and/or recording the amount of said liquid consumption as an updated amount of liquid consumption is used.

According to an embodiment herein, the system comprises a means for controlling the amount of said liquid and/or electrical energy consumption and wherein said system further comprises a means for designating a predetermined amount of allowable liquid and/or electrical energy consumption to a smartcard, which is identified with an electro-pump. The system further comprises a means for communicating with said smartcard for a bilateral data transmission via a smartcard reader, a means for checking, determining and confirming the validity of said smartcard, a means for reading the maximum predetermined amount of allowable liquid consumption from said smartcard, being characterized as liquid credit, a means for reading the maximum predetermined amount of allowable electrical energy consumption from said smartcard, being characterized as an energy credit, a means for continuously updating the liquid credit by subtracting the updated liquid consumption from said liquid credit and obtaining an updated amount of allowable liquid consumption, a means for continuously updating the energy credit by subtracting the updated energy consumption from said energy credit and obtaining an updated amount of allowable electrical energy consumption.

According to an embodiment herein, the method further comprises controlling the liquid credits and wherein said liquid credits comprise the amount of said liquid consumption, maximum flow of said liquid, allowable working hours, and allowable date and time. Said method further comprises designating a predetermined liquid credits and activating a bilateral data transferring means for transferring the designated predetermined liquid credits via a communication port. A validity of an exchanged data is checked, determined and confirmed. The liquid credit is continuously updating by subtracting the updated liquid consumption from said liquid credit and an updated amount of liquid consumption allowed is obtained. An interruption signal is sent to connect or disconnect said pump or electro-pump.

According to an embodiment herein, a system comprises a means for recording said amount of updated liquid and/or electrical energy consumption. When said amount of updated liquid and/or electrical energy consumption exceeds said maximum allowable limit of liquid and/or electrical energy consumption, a means is provided for obtaining and recording the amount exceeding the maximum allowable limit of liquid and/or electrical energy consumption.

According to an embodiment herein, a system comprises a means for sending an optional interruption signal to disable said electro-pump, when said amount of updated liquid and/or electrical energy consumption exceeds said maximum allowable limit of liquid and/or electrical energy consumption.

According to an embodiment herein, a system comprises a means for storing said calculated and updated active and reactive energies, said updated amount of said liquid consumption, said updated liquid credit, said updated electrical energy credit, and said calculated amount exceeding the maximum allowable limit of liquid and/or electrical energy consumption on said smartcard.

According to an embodiment herein, a method comprises continuously measuring the instant power consumption and instant rotational speed of said pump. The flow of said liquid pumped or transferred by pump is continuously calculated and updated. The amount of said liquid pumped or transferred by pump is continuously calculated, monitored, updated, displayed and/or recorded. The process of calculating and updating comprises the steps of calibrating the power-output flow curve of said pump at constant rotational speed, measuring an instant rotational speed of the pump, correcting the calibrated power-output flow curve of said pump, obtaining the amount of flow corresponding to the measured instant power consumption and the measured instant rotational speed from the corrected-calibrated power-output flow curve of said pump, and continuously calculating the volume of liquid pumped or transferred by performing a time integral of the amount of flow. The process of said calibrating the power-output flow curve of said pump at constant rotational speed comprises the steps of collecting a predetermined power-output flow curve of said pump as a first input data, and collecting one or more operating conditions of the pump as second input data. Said second input data comprises an instant flow of the pump and an instant power consumption of the pump at a constant rotational speed. The predetermined power-output flow curve is calibrated according to the collected operating conditions of the pump or the second input data comprising the instant flow of the pump and the instant power consumption of the pump at a constant rotational speed. The working condition of the pump is changed by changing a total discharge pressure of the pump and the instant power consumption and the instant flow of the pump at the changed working conditions. A power-output flow curve of said pump is created by changing the working conditions for one or more times.

According to an embodiment herein, a system is provided for measuring and controlling an amount of liquid consumed. The amount of liquid consumed includes a flow and/or volume of said liquid that is pumped or transferred by said pump. The system comprises a means for continuously measuring the instant power consumption of the pump and a means for continuously measuring an instant rotational speed of the pump directly. A means is provided for continuously calculating and updating the amount of said liquid consumed. The amount of said liquid consumed is calculated and updated by using a means for calibrating the power-output flow curve of said pump at a constant rotational speed. The instant rotational speed of the pump is measured to correcting a calibrated power-output flow curve of said pump. The amount of flow corresponding to the measured instant power consumption of the pump is collected from the corrected-calibrated power-output flow curve of said pump. A means is provided for continuously calculating the volume of pumped or transferred liquid by performing a time integral of the amount of flow. A means is provided for registering and displaying the amounts of flow and/or volume of liquid that is pumped or transferred by said pump in periodic time intervals. A means is provided for calculating, registering and displaying the maximum flow and/or volume of liquid that is pumped or transferred by said pump in the periodic time intervals. A means is provided for calculating, registering and displaying the working hours of the pump.

According to an embodiment herein, a system is for measuring and controlling the amount of liquid consumption. The amount of liquid consumption comprises the flow and/or volume of said liquid that is pumped or transferred by electro-pump. The system comprises a means for continuously measuring currents and voltages of said electro-pump; a means for continuously calculating and updating active and reactive energies, instant electrical power, instant power factor of said voltages; and a means for continuously calculating and updating the amount of said liquid consumption. The amount of liquid consumed is calculated and updated using a means for calibrating the power-output flow curve of said pump at a constant rotational speed; a means for measuring the frequency of voltage feeds electro-pump and correcting calibrated power-output flow curve of said pump; a means for obtaining the amount of flow from the corrected-calibrated power-output flow curve of said pump corresponding to the measured instant power; a means for continuously calculating the volume of liquid pumped or transferred by taking a time integral of the amount of flow; a means for registering and displaying the amount of flow and/or volume of liquid that is pumped or transferred by said pump in time intervals; a means for calculating, registering and displaying the maximum flow and/or volume of liquid that is pumped or transferred by said pump in time intervals; a means for calculating, registering and displaying the working hours of a pump; a means for registering and displaying the measured electrical parameters, including voltages, currents, active power and energy, reactive power and energy, and frequency in different registers and tariffs; and a means for changing tariffs by time, date and/or amount of liquid that is pumped or transferred.

According to an embodiment herein, the system comprises a means for communications for transferring data, settings and commands via different types of communication media and protocols such as GSM/GPRS, SMS, ZigBee, RF, M-Bus, RS485, RS232, PLC, DLC, smartcard, etc.

According to an embodiment herein, the system comprises a system or means is added to conventional energy/power meters to calculate/register/manage the volume and flow of pumped liquid. The system comprises a means for calculating/registering/managing volume and flow of pumped liquid as a part of a distributed system by gathering/collecting the needed information from conventional measuring tools; a means for calculating/registering/managing volume and flow of pumped liquid that is integrated with pump drivers; a self-determining device that measures/calculates/registers/manages the volume and flow of pumped liquid based on the required information collected from the conventional measuring tools; and a self-determining, integrated device that measures/calculates/registers/manages consumed energy/power/rotational speed, if applicable, and the volume and flow of liquid pumped.

The various embodiments herein provide a method for measuring the amount of flow and/or volume of liquid that is pumped or transferred by pump. The method comprises continuously measuring the instant power consumed by the pump, continuously measuring the instant rotational speed of the pump, continuously calculating and updating the amount of said liquid pumped or transferred, and continuously monitoring, updating, displaying and/or recording the amount of said liquid consumption. The method of calculating and updating comprises the step of calibrating the power-output flow curve of said pump in constant rotational speed. The step of calibrating the power-output flow curve comprise taking a predetermined power-output flow curve of said pump as a first input data, taking one or more operating conditions of the pump as second input data. The second input data comprises the instant flow and instant power consumption of the pump at the constant rotational speed of the pump. The step of calibrating the power-output flow curve further comprises calibrating the predetermined power-output flow curve according to said operating conditions, obtaining a calibrated power-output flow curve, measuring an instant power consumption and an instant flow of said pump, changing the working conditions of the pump by changing the total discharge pressure of the pump, measuring the instant power consumption and instant flow of the pump at the changed working condition, and creating power-output flow curve of said pump by changing the working conditions for one or more times. The step of calculating and updating further comprises measuring the instant rotational speed of the pump at each changed working condition and correcting calibrated power-output flow curve of said pump, obtaining the amount of flow corresponding to the measured instant power consumption of the pump from the corrected-calibrated power-output flow curve of said pump and continuously calculating the volume of liquid pumped or transferred by taking a time integral of the amount of flow obtained from the calibration corrected power-output flow curve of the pump.

A system for measuring the amounts of liquid pumped is provided. The said amount of liquid pumped comprises the flow and/or volume of said liquid that is pumped or transferred by said pump. The system comprises a means for continuously measuring the instant power consumption of the pump, a means for continuously measuring the instant rotational speed of the pump, and a means for continuously calculating and updating the amount of said liquid consumption.

The said means for continuously calculating and updating the amount of said liquid consumption comprises a means for calibrating the power-output flow curve of said pump at constant rotational speed, a means for measuring the instant rotational speed of the pump and correcting the calibrated power-output flow curve of said pump, a means for obtaining the amount of flow corresponding to the measured the instant power consumption of the pump from the calibration corrected power-output flow curve of said pump, and a means for continuously calculating the volume of pumped or transferred liquid by taking a time integral of the amount of flow obtained from the calibration corrected power-output flow curve of said pump.

The said means for calibrating the power-output flow curve comprises a means for taking a predetermined power-output flow curve of said pump as a first input data and a means for taking one or more operating conditions of the pump as a second input data. The said second input data comprises the instant flow and instant power consumption of the pump at a constant rotational speed of the pump. The said means for calibrating the power-output flow curve further comprises a means for calibrating the predetermined power-output flow curve according to said operating conditions and obtaining a calibrated power-output flow curve, a means for measuring an instant power consumption and instant flow of said pump, a means for changing working conditions of the pump by changing total discharge pressure of the electro-pump and measuring the instant power consumption and an instant flow of the pump at the changed working condition, and a means for creating a power-output flow curve of said electro-pump by changing of the working conditions of the pump for multiple times.

A system for measuring the amount of liquid pumped by the electro-pump is provided. The said amount of liquid comprises the flow and/or volume of said liquid that is pumped or transferred by said pump. The said electro-pump means comprises a means for continuously measuring the currents and the voltages of said electro-pump, a means for continuously calculating and updating active and reactive energies, instant electrical power, and instant power factor of said voltages, and a means for continuously calculating and updating the amount of said liquid consumption. The said means for calculating and updating comprises a means for calibrating the power-output flow curve of said electro-pump at constant rotational speed, a means for measuring the frequency of voltage feeds electro-pump and correcting the calibrated power-output flow curve of said pump, a means for obtaining the amount of flow corresponding to the measured power consumption from the calibration corrected power-output flow curve of said pump, and a means for continuously calculating the volume of pumped or transferred liquid by taking a time integral of the amount of flow obtained from the calibration corrected power-output flow curve of said pump.

The said means for calibrating of the power-output flow curve of the electro-pump comprises a means for taking a predetermined power-output flow curve of said pump as a first input data and a means for taking one or more operating conditions of the electro-pump as second input data. The said second input data comprises the instant flow and instant power consumption of the electro-pump at a constant rotational speed. The said means for calibrating the power-output flow curve further comprises a means for calibrating the predetermined power-output flow curve according to said operating conditions and obtaining a calibrated power-output flow curve, a means for measuring an instant power consumption and instant flow of said electro-pump, a means for changing the working conditions of the electro-pump by changing the total discharge pressure of the electro-pump, and measuring the instant power consumption and instant flow of the electro-pump, and a means for creating a power-output flow curve of said electro-pump by changing the working conditions of the electro-pump.

The said system for measuring the amount of liquid pumped by electro-pump further comprises a means for registering and displaying the amount of flow and/or volume of liquid that is pumped or transferred by said electro-pump in periodic time intervals, a means for calculating, registering and displaying the maximum amount flow and/or volume of liquid that is pumped or transferred by said electro-pump in periodic time intervals, and a means for calculating, registering and displaying the working hours of the electro-pump.

The said system for measuring the amount of liquid pumped by electro-pump further comprises a means for registering and displaying the measured electrical parameters, including voltages, currents, active power and energy, reactive power and energy, and frequency in different registers and tariffs and a means for changing tariffs by time, date and/or amounts of liquid pumped or transferred.

The said system for measuring the amount of pumped liquid by electro-pump further comprises a means for communicating for transferring data, settings and commands via different type of communication media and protocols such as GSM/GPRS, SMS, ZigBee, RF, M-Bus, RS485, RS232, PLC, DLC and smartcard, and a means for controlling the liquid credits. The said liquid credits comprise the amount of said liquid consumption/maximum flow of said liquid/allowable working hours/allowable date and time.

The said system for measuring the amount of pumped liquid by electro-pump further comprises a means for designating predetermined liquid credits, a means for bilateral transfer of predetermined liquid credits via said communication port, a means for checking, determining and confirming the validity of exchanged data, and a means for continuously updating the liquid credits by subtracting the updated liquid consumption from said liquid credit and obtaining an updated allowable limit of liquid consumption.

The said system for measuring the amount of liquid pumped by an electro-pump also comprises a means for sending an interruption signal to control a connection or disconnection of said pump or electro-pump.

According to an embodiment herein, the developed metering system provides a unique and applicable solution for monitoring and managing valuable water resources. The developed meter is simple to install, operate, and maintain. At the same time, the developed meter is robust, accurate and more economical. Furthermore, the amount of flow/volume of liquid that pumped or transferred by an electro-pump, unlike conventional water meters such as displacement water meters, velocity water meters, electromagnetic meters and ultrasonic meters, is determined based on electrical parameters such as instant power, instant rotational speed and corrected-calibrated power-flow curve of pumps, etc. The electro-pump, includes all pumps but not limited to, pumps that are supplied by electro-motor or diesel. The meter which is developed based on the embodiments herein overcomes the disadvantages and problems of conventional water meters used for measuring and monitoring the water pumped out of underground water resources and especially the problem of preventing from illegal water/energy consumption using a built-in controlling/managing system.

The embodiments herein integrate the features of measuring and controlling the volume of liquid and the amount of energy in one casing, thereby, providing a secure reference for both the parameters at the same time for underground water resources.

The various embodiments herein provide a method for measuring the amount of flow and/or volume of liquid that is pumped or transferred by pump. The method comprises continuously measuring the instant power consumption of the pump, measuring instant rotational speed of the pump continuously, calculating and updating the amount of said liquid pumped or transferred continuously, and monitoring, updating, displaying and/or recording the amount of said liquid consumption continuously. The method of calculating and updating comprises the steps of calibrating the power-output flow curve of said pump in constant rotational speed. The step of calibrating the power-output flow curve comprises taking a predetermined power-output flow curve of said pump as a first input data and taking one or more operating conditions of the pump as the second input data. The second input data comprises the instant-flow and instant power consumption of the pump at a constant rotational speed of the pump. The step of calibrating the power-output flow curve further comprises calibrating the predetermined power-output flow curve according to said operating conditions and obtaining a calibrated power-output flow curve, measuring an instant power consumption and an instant flow rate of said pump, changing the working conditions of the pump by changing the total discharge pressure pump, measuring the instant power consumption and the instant flow rate of the pump at the changed working condition, and creating a power-output flow curve of said pump by changing the working conditions for multiple times.

The step of calculating and updating the amount of said liquid pumped or transferred by the pump further comprises measuring the instant rotational speed of the pump, correcting the calibration power-output flow curve of said pump, obtaining the amount of flow corresponding to the measured instant power consumption of the pump from the calibration corrected power-output flow curve of said, and continuously calculating the volume of pumped or transferred liquid by taking a time integral of the amount of flow rate obtained from the calibration corrected power-output flow curve.

A system for measuring the amount of liquid pumped is provided. The said amount of liquid comprises the flow rate and/or volume of said liquid that is pumped or transferred by said pump. The system comprises a means for continuously measuring the instant power consumption of the pump, a means for continuously measuring the instant rotational speed of the pump, and a means for continuously calculating and updating the amount of said liquid consumption.

The said means for calculating and updating the amount of said liquid consumption comprises a means for calibrating the power-output flow curve of said pump at a constant rotational speed, a means for measuring the instant rotational speed of the pump and correcting the calibrated power-output flow curve of said pump, a means for obtaining the amount of flow corresponding to the measured instant power consumption of the pump from the calibration corrected power-output flow curve of said pump, and a means for continuously calculating the volume of pumped or transferred liquid by taking a time integral of the amount of flow obtained from the calibration corrected power-output flow curve.

The said means for calibrating the power-output flow curve comprises a means for taking a predetermined power-output flow curve of said pump as a first input data and a means for taking one or more operating conditions of the pump as second input data. The said second input data comprises the instant flow and instant power consumption at a constant rotational speed of the pump. The said means for calibrating the power-output flow curve further comprises a means for calibrating the predetermined power-output flow curve according to said operating conditions and obtaining a calibrated power-output flow curve, a means for measuring the instant power consumption and instant flow of said pump, a means for changing the working conditions of the pump by changing the total discharge pressure of the electro-pump, measuring an instant power consumption and an instant flow of the pump, and a means for creating a power-output flow curve of said electro-pump by changing the working conditions of the pump for multiple times.

A system for measuring the amount of liquid pumped by an electro-pump is provided. The said amount of liquid comprises the flow and/or volume of said liquid that is pumped or transferred by said electro-pump. The said electro-pump is a pump that is provided with an electro-motor. The system comprises a means for continuously measuring the current and voltage of said electro-pump, a means for continuously calculating and updating active and reactive energies, instant electrical power, instant power factor of said voltages, and a means for continuously calculating and updating the amount of said liquid consumption.

The said means for calculating and updating the amount of said liquid consumption comprises a means for calibrating the power-output flow curve of said electro-pump at a constant rotational speed, a means for measuring the frequency of voltage feeds electro-pump and correcting the calibrated the power-output flow curve of said electro-pump, a means for obtaining the amount of flow corresponding to the measured power consumption from the calibration corrected power-output flow curve of said electro-pump, and a means for continuously calculating the volume of pumped or transferred liquid by taking a time integral of the amount of flow obtained from the calibration corrected power-output flow curve.

The said means for calibrating the power-output flow curve comprises a means for taking a predetermined power-output flow curve of said electro-pump as a first input data and a means for taking one or more operating conditions of the electro-pump as second input data. The said second input data comprises the instant flow and instant power consumption of the electro-pump at a constant rotational speed of the electro-pump. The said means for calibrating of the power-output flow curve further comprises a means for calibrating the predetermined power-output flow curve according to said operating conditions of the electro-pump and obtaining a calibrated power-output flow curve, a means for measuring instant power consumption and instant flow of said electro-pump, a means for changing the working conditions of the electro-pump by changing the total discharge pressure of the electro-pump, a means for measuring the instant power consumption and the instant flow of the electro-pump at the changed working condition, and a means for creating a power-output flow curve of said electro-pump by changing the working conditions of the electro-pump for multiple times.

The said system for measuring the amount of pumped liquid and the said system for measuring the amounts of liquid pumped by electro-pump further comprises a means for registering and displaying the amounts of flow and/or volume of liquid that is pumped or transferred by said electro-pump in preset time intervals; a means for calculating, registering and displaying the maximum flow and/or volume of liquid that is pumped or transferred by said electro-pump in the preset time intervals, and a means for calculating, registering and displaying the working hours of the electro-pump.

The said system for measuring the amount of liquid pumped by electro-pump further comprises a means for registering and displaying the measured electrical parameters, including voltages, currents, active power and energy, reactive power and energy, frequency in different registers and tariffs, and a means for changing tariffs by time, date and/or amount of pumped or transferred liquid.

The said system for measuring the amount of liquid pumped by electro-pump further comprises a means for communicating for transferring data, settings and commands via different type of communication media and protocols such as GSM/GPRS, SMS, ZigBee, RF, M-Bus, RS485, RS232, PLC, DLC, and smartcard, and a means for controlling the liquid credits. The said liquid credits comprise the amount of said liquid consumption/maximum flow of said liquid/allowable working hours/allowable date and time.

The said system further comprises a means for designating predetermined liquid credits, a means for transferring predetermined liquid credits via said communication port bilaterally; a means for checking, determining and confirming the validity of exchanged data; and a means for continuously updating the liquid credits by subtracting the updated liquid consumption from said liquid credit and obtaining an updated allowable limit of liquid consumption.

The said system for measuring the amounts of liquid pumped by electro-pump also comprises a means for sending an interruption signal to control the connecting/disconnecting operation of said pump/electro-pump. The said system for measuring the amounts of liquid pumped by electro-pump is implemented as a self-determining integrated device that measures/calculates/registers/manages the consumed energy/power/rotational speed and the volume and flow of pumped liquid. The self-determining device measures/calculates/registers/manages the volume and flow of pumped liquid by collecting the required information from conventional measuring tools.

The said system for measuring the amount of liquid pumped by electro-pump comprises a means for adding to conventional energy/power meters to calculate/register/manage the volume and flow of pumped liquid, a means for calculating/registering/managing volume and flow of pumped liquid as a part of a distributed system by collecting the required information from the conventional measuring tools, and a means integrated with the pump drivers for calculating/registering/managing volume and flow of pumped liquid.

Figure 2:
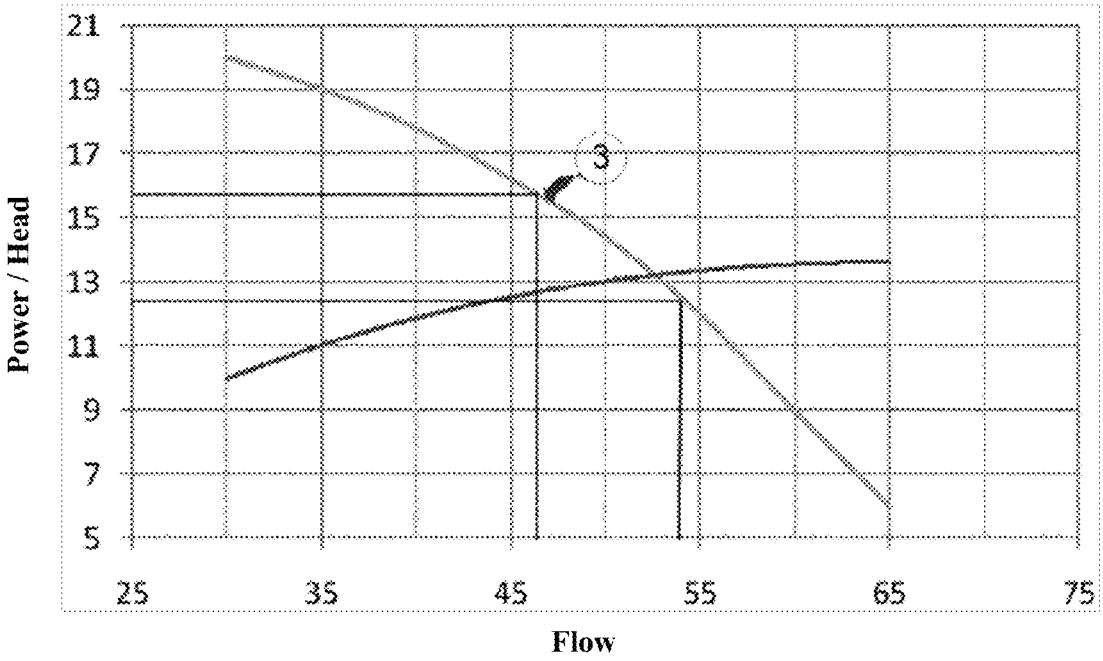
FIG. 2 illustrates the head-flow and power-flow curves of a typical pump, according to an embodiment herein.

In each specific pump, the mechanical output power is a function of both the flow and head. As seen in FIG. 1, there is just one mechanical output power related to each specific pair of flow and head in a particular pump and FIG. 2 illustrates this more clearly. For instance, when a valve throttles the discharge path of the pump, the head imposed to the pump will increase and consequently the output flow and the power output will decrease reciprocally to indicate that the power-flow curves of the pump indicate the related flow and head characteristics corresponding to each power consumption or output power of a specific pump.

In the case of an electro-pump, a unique relation between the electrical power consumption and the output flow is achieved based on the analysis of an efficiency curve of the electromotor combined with the analysis of the power-output flow curve of the pump, wherein the efficiency curve of the electromotor illustrates a relation between the mechanical output power and the electrical power consumption of the electromotor.

Figure 3:
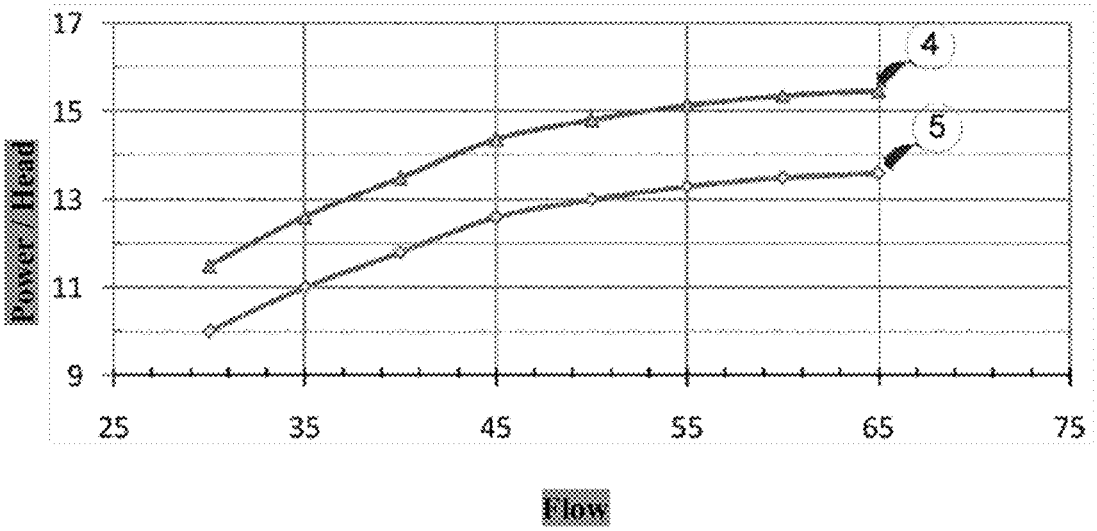
FIG. 3 illustrates a default power-output flow curve of a typical pump and a modified power-output flow curve of that pump that was amended according to the embodiment herein.

The FIG. 3 show the power-output flow curve of a pump (4) based on the datasheets of the pump manufacturer, and an updated output power-output flow curve (5) based on the output efficiency curve of the electro-pump and an operating condition of the electro-pump. In an actual operating condition, the power-output flow curve of an electro-pump may deviate slightly from the curve issued by the manufacturer as a design curve. Hence the curves issued by the manufacturer should be corrected according to the actual operating conditions in order to achieve a more accurate measurement. In this article, this correction procedure is called "calibration". Therefore this updated output power-output flow curve (5) is not only a combination of the power-output flow curve (4) and the output efficiency curve of the electromotor, but also a probable calibration-corrected curve. As a result, said updated power-output flow curve (5) identifies the relation between the output flow and the electrical power consumption of the electro-pump.

Therefore the said power-output flow curve enables us to determine a corresponding output flow by knowing the instant electrical power consumption of said electro-pump. In other words, the instant output flow is easily estimated by locating the instant power consumption on the power-output flow curve.

Figure 4:
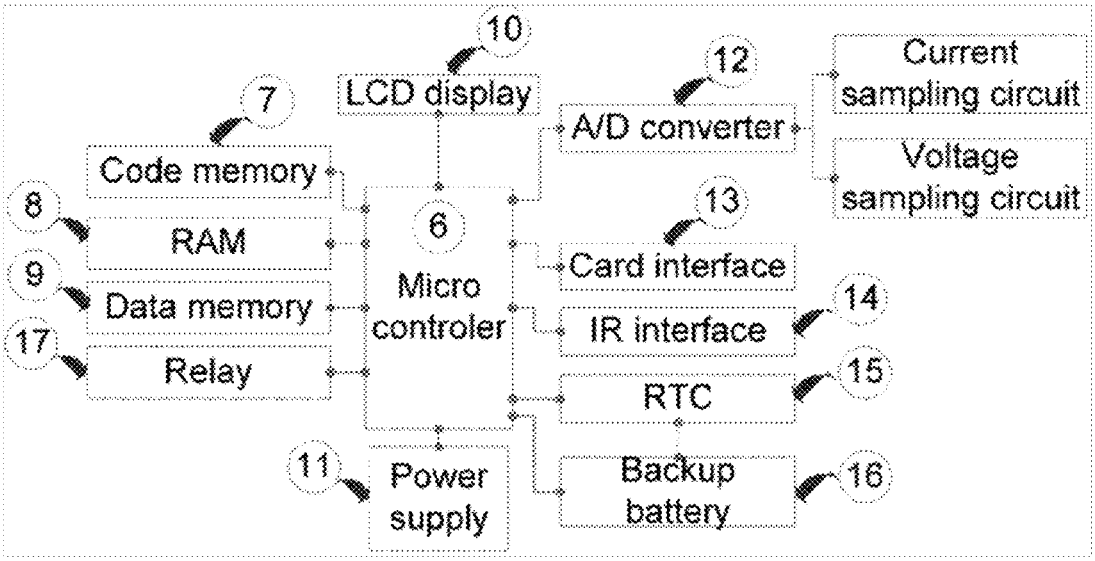
FIG. 4 illustrates a block-diagram of the system of the embodiment herein.

Volume is considered as a time integral of an output flow. So the volume of liquid that was pumped or transferred during a period is derived by integrating the instant output flow over a specific period of time in the present invention. The block diagram of a system of the present invention is shown in FIG. 4. According to an embodiment herein, the system is provided with a microcontroller-based system and digital processing routines to execute and perform all aforementioned measurements and calculations.

A basic block diagram of a meter which is developed based on the system of the present invention is shown FIG. 4. The physical installation procedure of this meter on the electric power circuit of an electro-pump is same as the procedure followed in the conventional digital energy meters. When the meter shown in FIG. 4 is installed on the electric power circuit of an electro-pump, the meter continuously measures the current and voltage levels of the electro-pump and calculates the active/reactive energies, instant electrical power, instant power factor and the frequency exactly as the conventional digital energy meter does. The meter also displays and/or records said measured/calculated electrical parameters.

The meter disclosed in the present invention and shown in FIG. 4 calculates the amount of flow/volume of liquid pumped or transferred by the said electro-pump using the novel algorithm hitherto illustrated in FIG. 1 to FIG. 3 and also displays and/or records the calculated values. Hereafter, the amount of flow/volume of liquid pumped or transferred by the said electro-pump is called "liquid consumption" for brevity.

In addition to the above mentioned features, the meter shown in FIG. 4 provides a credit controlling facility. The said meter manages and controls the liquid/energy consumption using a smartcard system and said smartcard system can read/write from/to a smartcard. Therefore, the preset maximum limit for a liquid volume that is allowed to be pumped or transferred and/or the preset maximum limit for an electrical energy consumption that is permitted can be recorded on a smartcard and transmitted to said meter. In this article, wherever specified, "liquid credit" and "energy credit" refer to "the volume of liquid that is allowed to be pumped or transferred," and "the amount of electrical energy consumption that is permitted," respectively.

The meter shown in FIG. 4 continuously monitors, updates and records the liquid pumped or transferred and the power consumption.

The meter shown in FIG. 4 continuously updates the remaining "liquid credit" by subtracting the last updated "liquid consumption" from said maximum predetermined "liquid credit." The meter shown in FIG. 4 also continuously updates the remaining "energy credit" by subtracting the last updated amount of energy consumed from said maximum predetermined "energy credit." If the last updated "liquid consumption" exceeds said maximum predetermined "liquid credit" or the last updated amount of energy consumed exceeds said maximum predetermined "energy credit," the remaining "liquid credit"/"energy credit" takes a negative value. In this case, the values of the remaining "liquid credit" and "energy credit," indicate the amount of illegal consumption of liquid and energy which are recorded in separate registers.

Furthermore, the meter shown in FIG. 4 includes an auxiliary relay that may be programmed to send an interruption command to the electrical power circuit of said electro-pump, in case of illegal energy/liquid consumption. It should be noted that there must be a power interrupting device in the electrical power circuit of the electro-pump to receive the said interrupting command to enforce the power circuit interruption.

In the meter shown in FIG. 4, all the information measured/calculated and recorded in the said meter is transferred to a smartcard for external use, when a valid smartcard is inserted in the meter.

The meter shown in FIG. 4 includes an infrared port based on IEC 62056 standard that is obliged almost by all national and regional standards for digital energy meters. This port is used as a Human Machine Interface (HMI) for necessary adjustments, calibration, reading the recorded parameters and so on.

Hereafter, all functions of the blocks shown in FIG. 4 are presented briefly. With respect to FIG. 4, a system is provided with a microcontroller 6 connected to a Liquid Crystal Display (LCD) 10 for displaying all measured, calculated and/or recorded parameters in the meter. The system includes volatile and nonvolatile memories including RAM 8, data memory 9 and code memory 7 which act as a storage space for recording the measured/calculated parameters and also partially act as the temporary memories for arithmetic operations. The system is further provided with analog-to-digital converters for voltages and currents 12, the current and voltage sampling circuits and smartcard interfacing circuits 13. The smartcard interfacing circuits 13 include the whole smartcard system provided with the relevant connector and other components to connect the meter to the smartcard system, according to ISO 7816 standard. An Infrared interface 14 is connected to the infrared port which is arranged to comply with IEC 62056 standard. A Real Time Clock (RTC) circuit 15 is connected to make a precise reference for the time and date in the meter. The RTC circuit can be an internal circuit (included in the micro controller) or an external one. One or two backup batteries 16 are provided to secure the continuous operation of the RTC system and also to make the Read Without Power (RWP) facility available. An auxiliary relay 17 is provided for interrupting the power circuit and enforcing the ban on liquid and/or energy consumption, as mentioned before.

Figure 5:
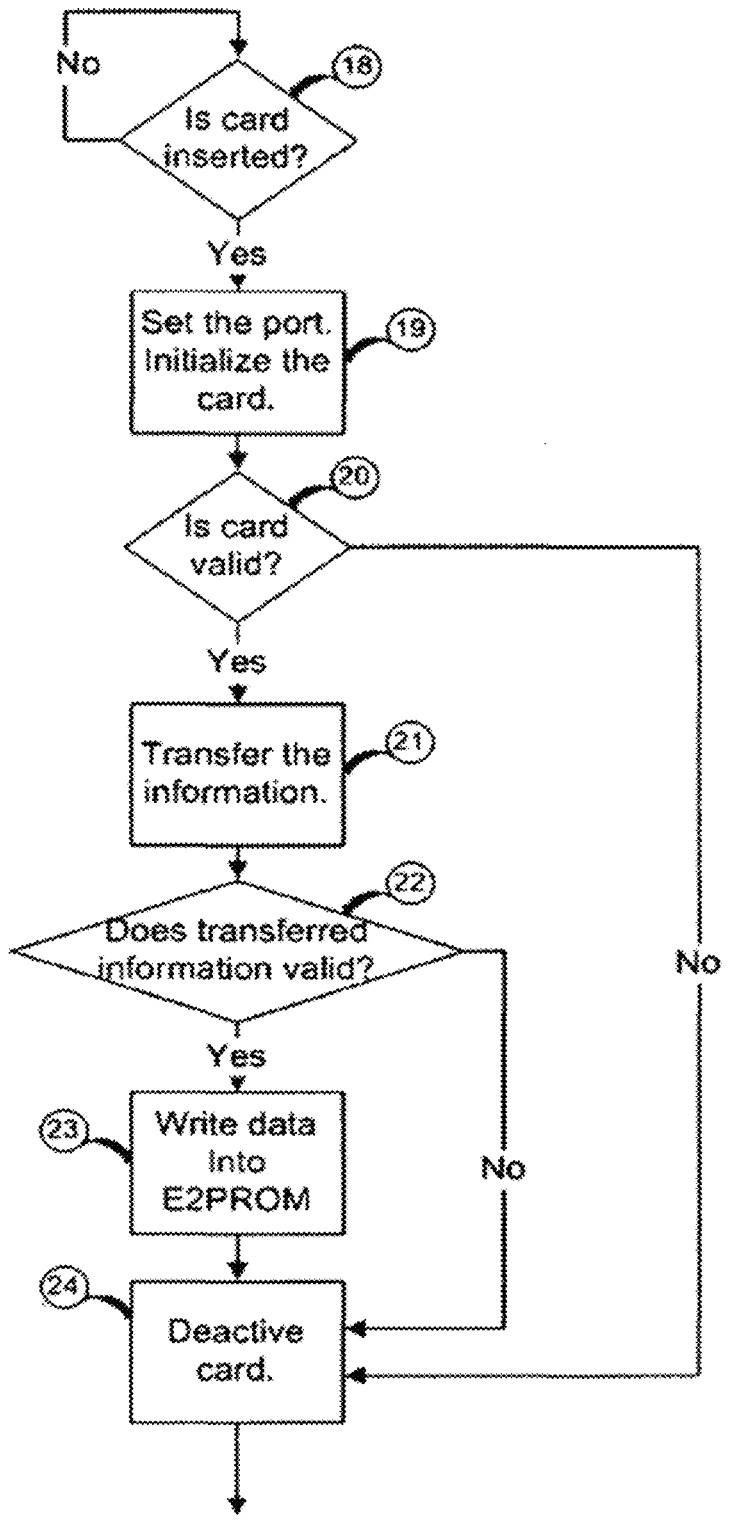
FIG. 5 illustrates a flowchart for a smartcard response routine according to an embodiment herein.

FIG. 5 illustrates a flowchart of a routine response of a smartcard. The routine response is carried out in the following sequences. While carrying out the routine response of the smartcard, the card-reader is connected to the smart card through a connector to continuously check whether the card is inserted by using a micro-switch (18). When the insertion of the smart card in the meter is detected, the routine proceeds to set the communication port to initialize the smart card according to ISO 7816 (19). After the initialization process, the validity of the card is checked (20). When the card is not a valid card, then the card is deactivated (24). When the card is found to be a valid card, a data is transferred between the card and the meter (21). The validation of the transferred data is checked and confirmed (22). When the transferred data is found valid, the data is written in EEPROM of the meter (23). When the transferred data is not found valid, the card is deactivated (24).

Figure 6:
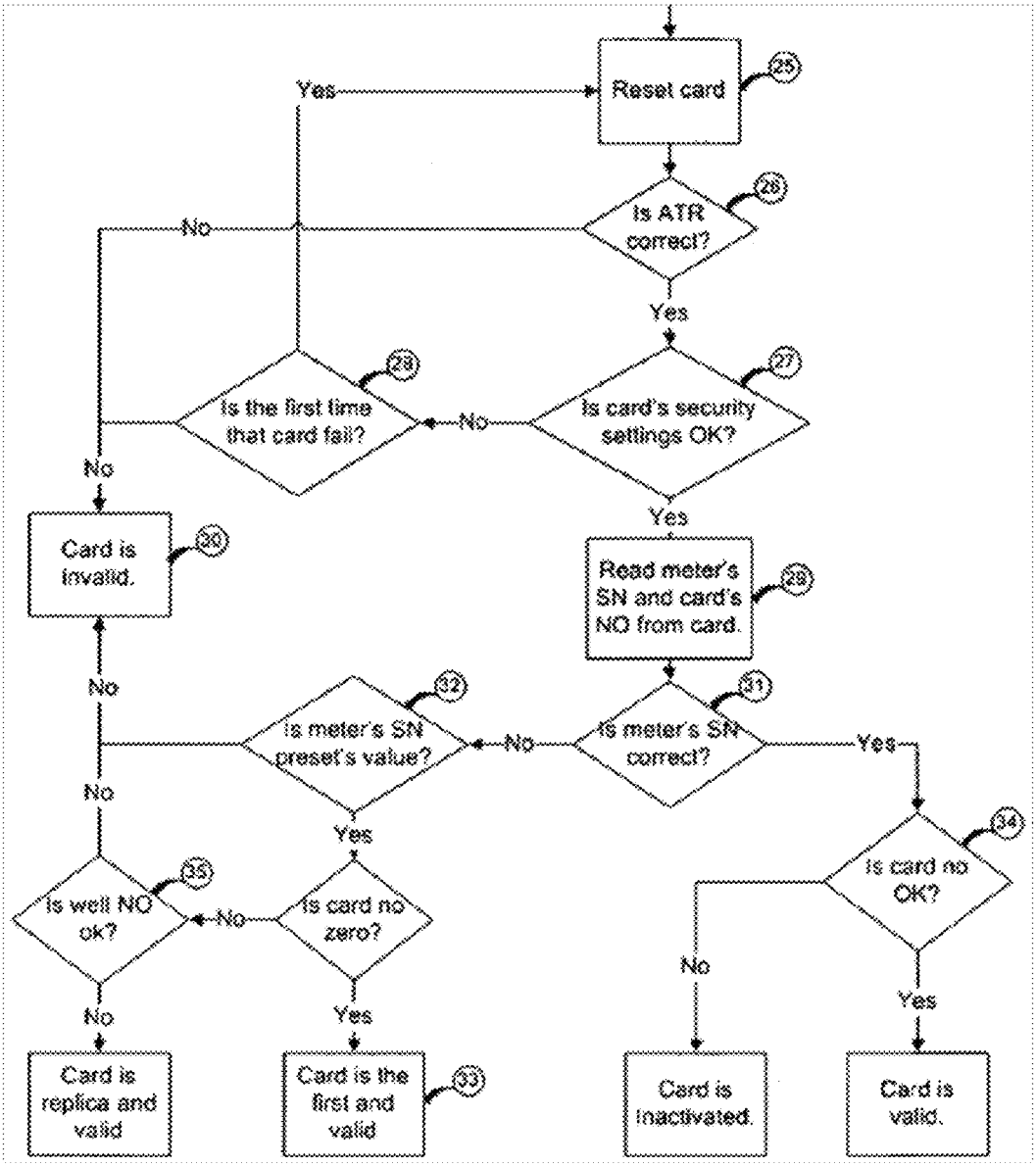
FIG. 6 illustrates a flowchart for a validation routine check of the smartcard according to an embodiment herein.
Figure 7:
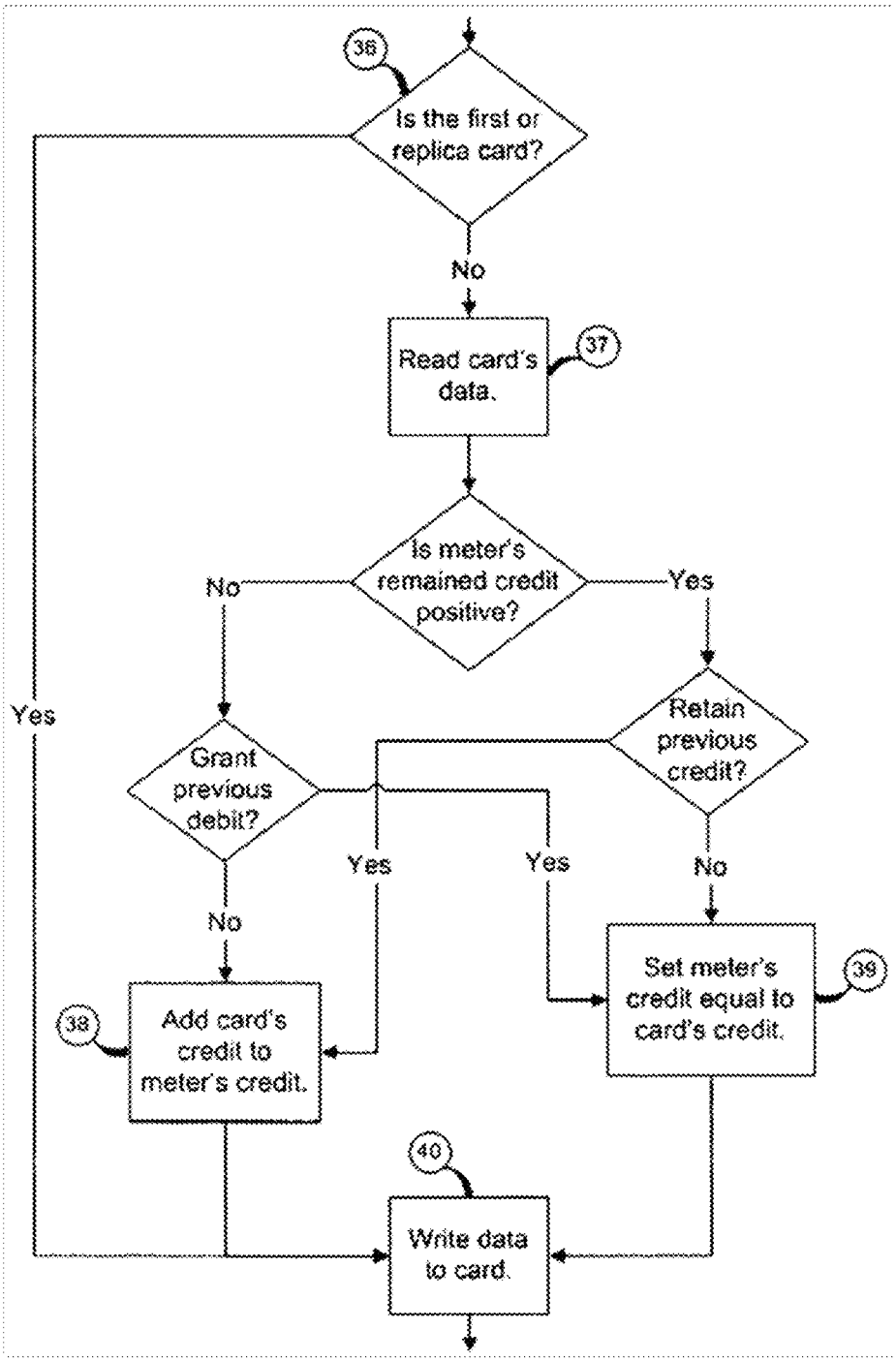
FIG. 7 illustrates a flowchart for the data transfer routine between the meter and the smartcard according to an embodiment herein.
Figure 8:
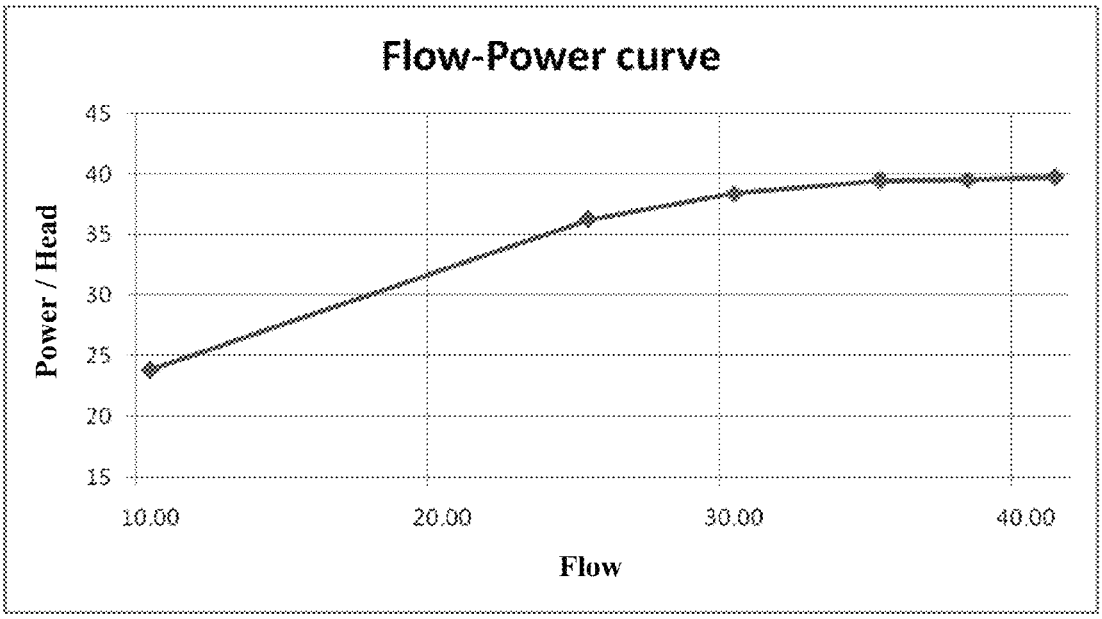
FIG. 8 illustrates the predetermined power-output flow curve of a typical pump according to an embodiment herein.

The flowchart of the validation routine of the card is illustrated in FIG. 6. The algorithm used the validation routine of the card is illustrated in FIG. 7. The validation routine of the card is depicted in FIG. 6. The validation routine of the card is carried out in the following sequences. The card reset command is sent (25). The Answer to Reset (ATR) command is received from the card and compared to the stored ATR (26). When the received answer is found to be correct, the security settings of the card are checked for validity and correctness (27). When the received answer is not found to be correct, the validity of the card is checked and the card is invalidated (30). The card is recognized and introduced as an invalid card The security settings (codes) are exchanged and checked by meter and smartcard, respectively, according to one of the security methods such as DES-3, supported by the smartcard (27). When the security settings (codes) are correct, the serial number (SN) of the meter and the card number are read from the card (29). When the security settings (codes) are not correct, it is checked to find whether the detected card failure is the first detected card failure event (28). When the detected card failure is the first detected card failure event, the card is reset (25). When the detected card failure is not the first detected card failure, then the card is invalidated or the card is declared invalid. The card is recognized and introduced as an invalid card (30).

The card number is read for recognizing the replica card, if applicable (29). The card is recognized and introduced as an invalid card (30). The serial number of the meter and the serial number of the card read from the card are checked for the correctness and reliability (31). When the serial number of the meter read from the card is found correct, then the serial number of the card read from the card is compared with serial number of the card read from the meter to check for the correctness (34). When the serial number of the card read from the card and the serial number of the card read from the meter are same, the card is judged to be a valid card. When the serial number of the card read from the card and the serial number of the card read from the meter are not same, then the card is considered out of date and is deactivated.

When the serial number of the meter read from the card is found incorrect, then the serial number of the meter is checked to find whether the serial number of the meter is equal to a preset value (32). When the serial number of the meter is equal to a preset value, then the serial number of the card is checked to find whether the value of the card number in the meter is equal to zero or not. When the value of card number is equal to zero, the card is recognized as a new card. The card is judged to be a first and valid card (33). When the value of the card number in the meter is equal to zero, the card is accepted as the first card of the meter. No other card can be allocated to the meter afterwards except for a replica card with its own algorithm. When the value of the card number in the meter is not equal to zero, then the serial number of the card is checked to find whether the serial number of the card is correct or not (35). When the value of the card number in the meter is not equal to zero and the serial number of the card is found to be correct, then the card is specified as a replica card and the card is treated as a valid card. When the value of the card number in the meter is not equal to zero and the serial number of the card is found to be incorrect, the card is judged as an invalid card. When the serial number of the meter is not equal to a preset value, then the card is treated as an invalid card.

FIG. 7 illustrates a flow chart for a data transfer process between the meter and the card. The data transfer process between the meter and the card is performed in the following sequences. The card is checked to find whether the card is the first card or a replica card (36). When the card is found to be the first card or replica card, then the acquired and calculated data are written in the card. When the card is not the first card or not a replica card, the card data is read (37). The credit value stored in the card is read and checked to find whether the stored credit value is a positive value or not. When the stored credit value in the card is a positive residual credit, the residual credit value is retained and the credit in the card is added to the credit data in the meter (38). The residual credit value in the card is shifted to the next credit-interval. The residual credit is added up to the new credit (as specified in the card) and the result is stored as new credit in the meter. When the stored credit value is a negative residual credit in the meter, this negative credit remaining in the card is ignored and the credit remaining in the meter is set equal to the credit remaining in the card (39). Then the new credit (as specified in the card) is stored as new credit in the meter. The entire data including both the electrical and hydraulic parameters is transferred from the meter to card and recorded in the card (40).

The present invention has been described with respect to a specific embodiment thereof and it will be understood that various changes and modifications will be suggested to one skilled in the art, and it is intended to encompass such changes and modifications as fall within the scope of the appended claims.

Figure 9:
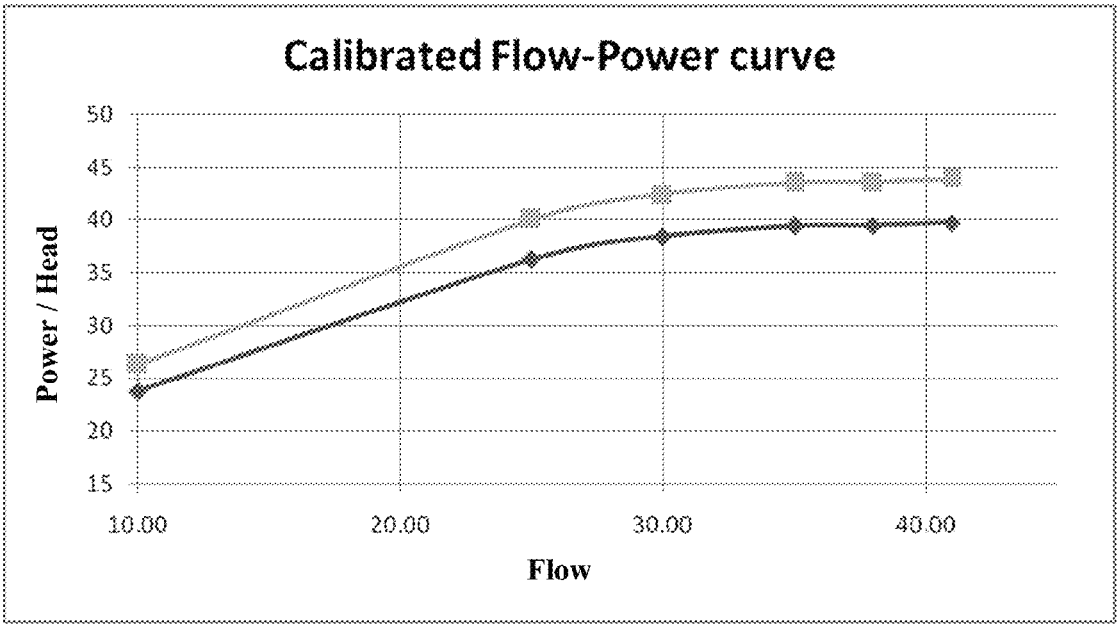
FIG. 9 illustrates a calibrated power-output flow curve of a typical pump according to an embodiment herein.

A sample power-output flow curve of a typical pump is shown in FIG. 9. In each pump, the power consumption is a function of both head and power. Variation in the discharge pressure of a specific pump results in a change in the output flow. Consequently, the observed power of the pump will be changed. The power-output flow curve of a pump illustrates the relation between power consumption and an output flow of pumped liquid. In an operating condition, power-output flow curve of a pump may deviate from the curve declared by the manufacturer. Hence the power-output flow curve is calibrated to achieve an accurate measurement. The calibration of the power-output flow curve of the pump at a constant rotational speed is done by measuring the flow and the power consumption of the pump in one or more operating conditions and changing the power-output flow curve of the pump proportionally to achieve a calibrated power-output flow curve. A typical calibrated power-output flow curve is shown in FIG. 11.

In some cases, the model of pump or predetermined power-output flow curve of the pump is unknown. In these cases, the new power-output flow curve should be created. The power-output flow curve of a pump is created in two major steps. At the first step, the instant power consumption and the instant flow of the pump is measured. In the second step, the working conditions of the pump are changed by changing the total discharge pressure of the pump. The instant power consumption and the instant flow of the pump are measured at the changed working conditions. A power-output flow curve of a typical pump created with respect to the changed working conditions is shown in FIG. 11.

Figure 10:
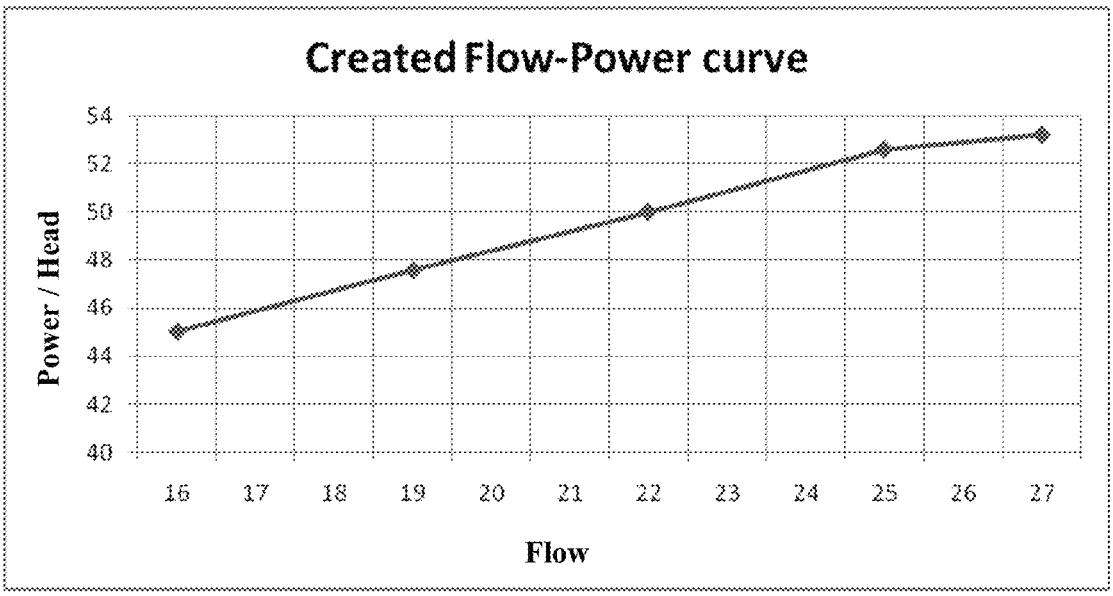
FIG. 10 illustrates a created power-output flow curve of a typical pump according to an embodiment herein.
Figure 11:
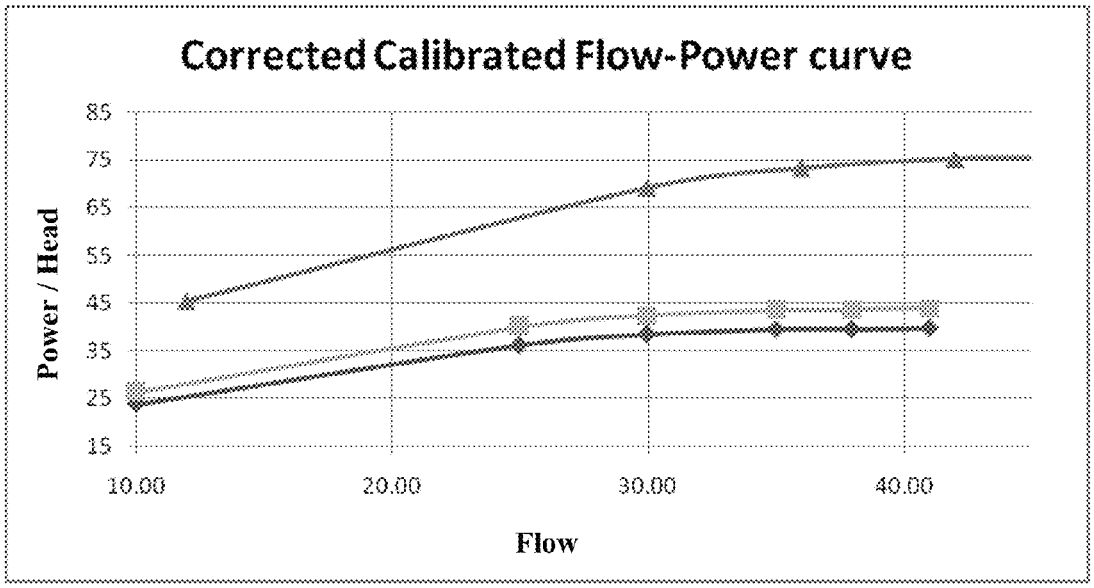
FIG. 11 illustrates a corrected-calibrated power-output flow curve of a typical pump according to an embodiment herein.

The power-output flow curves shown in FIG. 9, FIG. 10, and FIG. 11 are at constant pump rotational speed. A variation in pump rotational speed results in a change in the above mentioned curves. In the case of variation in pump rotational speed, the total pump discharge, the output flow and power consumption are changed according to the law of pump similarity. By correcting the calibrated power-output flow curve in proportional to the pump rotational speed based on law of pump similarity, a new curve which illustrates the relation between output flow and the power consumption of the pump at a given rotational speed is created. The new curve is called a corrected-calibrated power-output flow curve. The instant flow corresponding to the instant power consumption of the pump is obtained from calibration corrected curve. A calibration corrected power-output flow curve of a typical pump is shown in FIG. 11.

The foregoing description of the specific embodiments will so fully reveal the general nature of the embodiments herein that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation. Therefore, while the embodiments herein have been described in terms of preferred embodiments, those skilled in the art will recognize that the embodiments herein can be practiced with modification.

What is claimed is:

1. A method for measuring an amount of flow and a volume of liquid that is transferred by an underground water electro-pump using a controlling device with a microcontroller, wherein the method consists of:

providing an underground water electro-pump that is powered by an electro-motor;

operating the electro-pump to transfer liquid;

continuously measuring an instant power consumed by the electro-pump with an energy meter, continuously measuring an instant rotational speed of the electro-pump, and continuously calculating and updating an amount of flow and a volume of liquid transferred using the measured values of instant power and instant rotational speed, wherein the calculating and updating the amount of flow and volume of liquid transferred using the measured values of instant power and instant rotational speed consists of the steps of:

calibrating a flow-power curve of the electro-pump at a constant rotational speed, measuring an instant rotational speed of the electro-pump and correcting the calibrated flow-power curve based on a measured instant rotational speed of the electro-pump, and obtaining an amount of flow from the corrected calibrated flow-power curve by locating an instant power on the corrected calibrated flow-power curve, and continuously calculating a volume of transferred liquid by taking a time integral of the amount of flow;

wherein calibrating a flow-power curve of the electro-pump at a constant rotational speed consists of the steps of:

collecting a manufacturer-declared flow-power curve of said electro-pump as a first input data, and collecting one or more operating conditions of the electro-pump as second input data;

wherein said second input data consists of an instant flow of the electro-pump and an instant power consumption of the electro-pump at a constant rotational speed, and correcting the manufacturer-declared flow-power curve according to the second input data by changing the working conditions of the electro-pump one or more times such that a corrected calibrated flow-power curve is created, wherein changing the operating conditions of the electro-pump consists of changing a total discharge pressure of the electro-pump and then measuring an instant power consumption and an instant flow of the electro-pump, and obtaining a calibrated flow-power curve and operating the electro-pump at a desired flow and volume output with the controlling device through use of the obtained calibrated flow-power curve.

2. A system for measuring and controlling an amount of liquid pumped by an underground water electro-pump, wherein the amount of liquid pumped comprises a flow and a volume of liquid that is transferred, the system consisting of:

a means for continuously measuring an instant power consumed by the electro-pump;

a means for continuously measuring an instant rotational speed of the electro-pump;

a means for calibrating a flow-power curve of the electro-pump at a constant rotational speed;

a means for correcting the calibrated flow-power curve of said pump;

a means for obtaining an amount of flow from the corrected calibrated flow-power curve corresponding to a measured instant power on the corrected calibrated flow-power curve;

and a means for continuously calculating a volume of transferred liquid by taking a time integral of the obtained amount of flow;

wherein the means for calibrating a flow-power curve collects a manufacturer-declared flow-power curve of said electro-pump as a first input data, and collects one or more operating conditions of the pump as second input data, said second input data consisting of an instant flow of the pump and an instant power consumption of the pump at a constant rotational speed, wherein the means for correcting the calibrated flow-power curve corrects the manufacturer-declared flow-power curve based on a measured instant rotational speed of the pump and the second input data by changing the working conditions of the electro-pump one or more times such that a corrected calibrated flow-power curve is created, wherein changing the operating conditions of the electro-pump consists of changing a total discharge pressure of the electro-pump and then measuring an instant power consumption and an instant flow of the electro-pump, and wherein the means for calculating a volume of pumped liquid obtains an amount of flow from the corrected calibrated flow-power curve by locating an instant power on the corrected calibrated flow-power curve, and subsequently, calculates a volume of transferred liquid by taking a time integral of the obtained amount of flow.

3. The system according to claim 2, further comprising: a means for registering and displaying the amounts of flow and/or volume of liquid transferred by the electro-pump in a plurality of time intervals; a means for calculating, registering and displaying a maximum flow and/or volume of liquid transferred by the electro-pump within the plurality of time intervals; and a means for calculating, registering and displaying working hours of the electro-pump.

4. The system according to claim 2, further comprising: a means for communicating and transferring data, settings and commands through a plurality of communication medias and protocols and wherein the plurality of communication medias and protocols include GSM/GPRS, SMS, ZigBee, RF, M-Bus, RS485, RS232, PLC, DLC and Smartcard; a means for controlling liquid credits, wherein the liquid credits comprise a maximum amount of liquid consumption, a maximum flow of liquid, allowable working hours, and allowable date and time; and a means for connecting, disconnecting, and sending an interruption signal to control the electro-pump.

5. The system according to claim 4, wherein the means for controlling liquid credits comprises: a means for designating a predetermined amount of liquid credits; a means for bilateral transferring of the predetermined amount of liquid credits through the means for communicating and transferring data; a means for checking, determining and confirming a validity of exchanged data; and a means for continuously updating the amount of liquid credits by subtracting an updated amount of liquid consumption from the amount of liquid credits and obtaining an updated allowable amount of liquid consumption.

6. The system according to claim 2, wherein the system further comprises: a means for fitting or connecting to conventional energy meters to calculate, register, and manage a volume and a flow of pumped liquid; a means for calculating, registering, and managing a volume and flow of pumped liquid as a part of a distributed system by collecting a required information using a plurality of measuring tools; and a means for calculating, registering and managing a volume and a flow of pumped liquid.

* * * * *